US007575537B2

(12) United States Patent
Ellis

(10) Patent No.: US 7,575,537 B2
(45) Date of Patent: Aug. 18, 2009

(54) DUAL DIRECTION EXERCISE TREADMILL FOR SIMULATING A DRAGGING OR PULLING ACTION WITH A USER ADJUSTABLE CONSTANT STATIC WEIGHT RESISTANCE

(75) Inventor: Joseph K. Ellis, Ocala, FL (US)

(73) Assignee: Fitness Tools, LLC, Ocala, FL (US)

( * ) Notice: Subject to any disclaimer, the term of this patent is extended or adjusted under 35 U.S.C. 154(b) by 0 days.

(21) Appl. No.: 11/935,828

(22) Filed: Nov. 6, 2007

(65) Prior Publication Data

US 2009/0118103 A1 May 7, 2009

(51) Int. Cl.
*A63B 22/02* (2006.01)

(52) U.S. Cl. ..... 482/54; 482/5

(58) Field of Classification Search ..... 482/5, 482/54

See application file for complete search history.

(56) References Cited

U.S. PATENT DOCUMENTS 4,600,016 A * 7/1986 Boyd et al. ..... 600/595
4,625,962 A * 12/1986 Street ..... 482/116
5,226,866 A * 7/1993 Engel et al. ..... 482/70
5,254,064 A * 10/1993 Rock ..... 482/126
5,318,491 A * 6/1994 Houston ..... 482/54
5,527,245 A * 6/1996 Dalebout et al. ..... 482/54
5,951,449 A * 9/1999 Oppriecht ..... 482/113
6,042,516 A * 3/2000 Norton ..... 482/54
6,123,649 A * 9/2000 Lee et al. ..... 482/54
6,126,575 A * 10/2000 Wang ..... 482/54
6,454,679 B1 * 9/2002 Radow ..... 482/4
6,620,043 B1 * 9/2003 Haseltine et al. ..... 463/7
6,676,569 B1 * 1/2004 Radow ..... 482/4
6,723,028 B1 * 4/2004 Wang et al. ..... 482/54
7,052,440 B2 * 5/2006 Pyles et al. ..... 482/54
7,066,865 B2 * 6/2006 Radow ..... 482/4
7,220,219 B2 * 5/2007 Papadopoulos et al. ..... 482/57
7,381,163 B2 * 6/2008 Gordon et al. ..... 482/69
2004/0204294 A2 * 10/2004 Wilkinson et al. ..... 482/54
2005/0124471 A1 * 6/2005 Wilkinson ..... 482/121
2005/0209059 A1 * 9/2005 Crawford et al. ..... 482/54

(Continued)

*Primary Examiner*—Fenn C Mathew
*Assistant Examiner*—Andrew M Tecco
(74) *Attorney, Agent, or Firm*—Laurence P. Colton; Smith, Gambrell & Russell

(57) ABSTRACT

An exercise treadmill having an endless moveable surface looped around rollers or pulleys to form an upper run and a lower run, the movable surface being rotated when one of the rollers or pulleys is rotated, and an exercise surface for walking or running while exercising, a weight resistance mechanism for providing a weight resistance for simulating the dragging or pulling of a load, wherein the weight resistance can be adjusted and set to a specific weight resistance setting; a movable hand controller operatively attached to the weight resistance mechanism for operating and controlling the exercise treadmill and the weight resistance mechanism, wherein the endless movable surface moves in a direction simulating walking or running backwards, and wherein the weight resistance mechanism applies a constant and static force to the hand controller generally only in the same as the direction the endless movable surface moves and opposite a pulling direction, whereby operation of the treadmill simulates the dragging or pulling of a load by a combination of the actuation of the weight resistance mechanism to simulate the load and the walking or running backwards to provide the dragging or pulling action.

7 Claims, 11 Drawing Sheets

U.S. PATENT DOCUMENTS

2006/0281606 A1* 12/2006 Radow ..... 482/54
2007/0232463 A1* 10/2007 Wu ..... 482/94
2007/0287601 A1* 12/2007 Burck et al. ..... 482/54

* cited by examiner

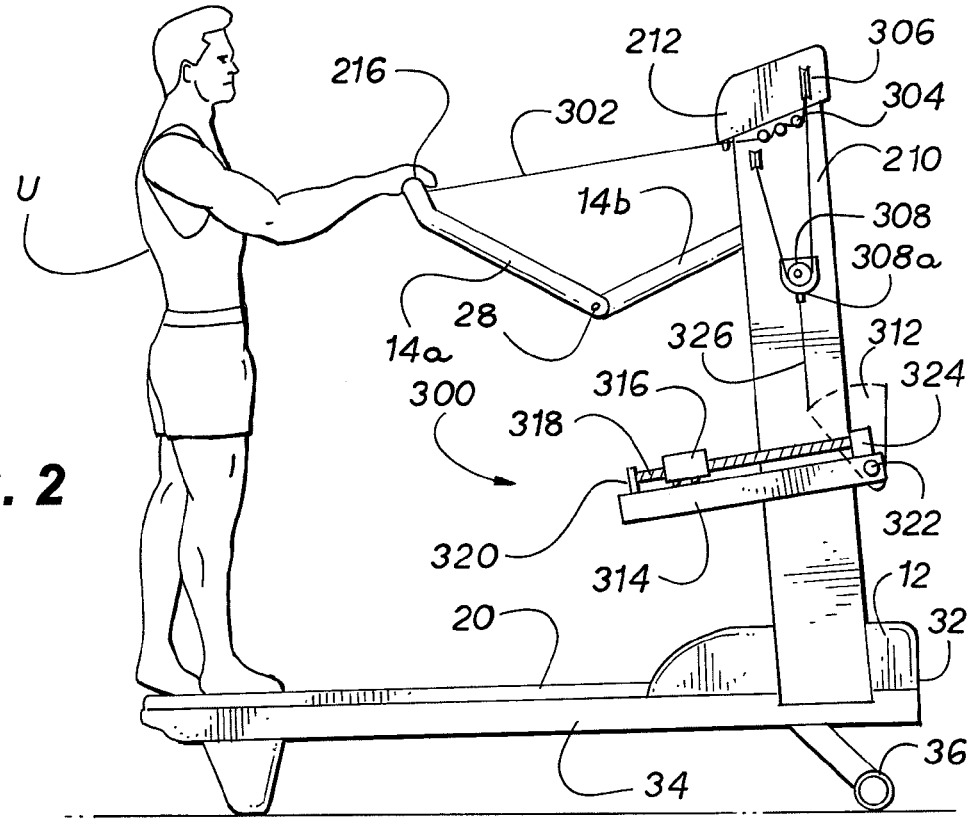
FIG. 2
FIG. 3
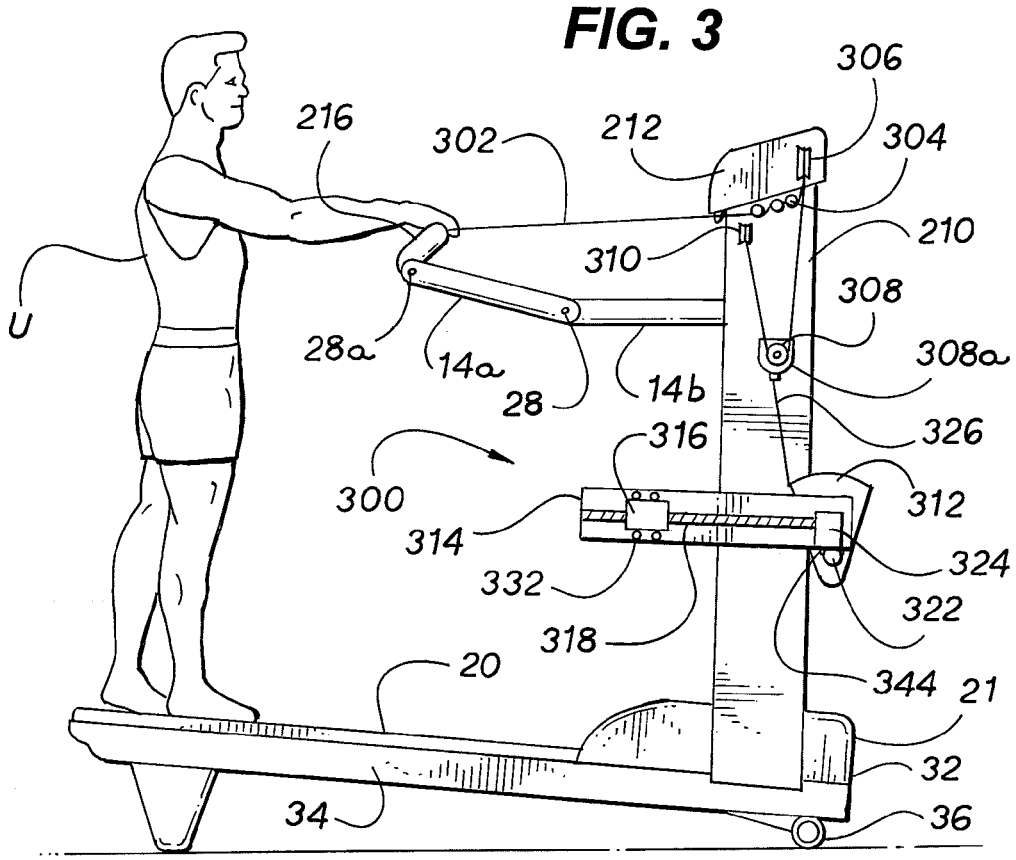

FIG. 7
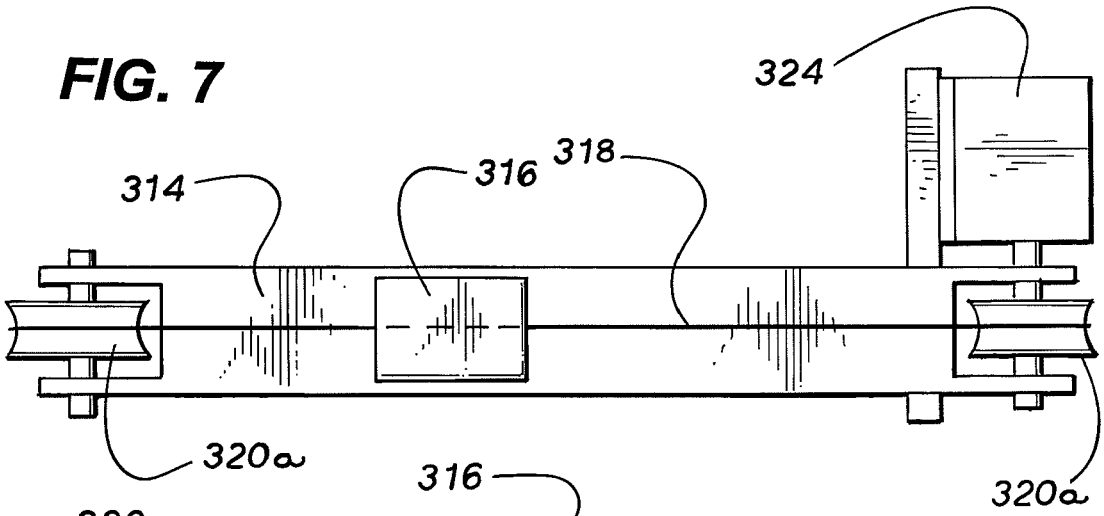
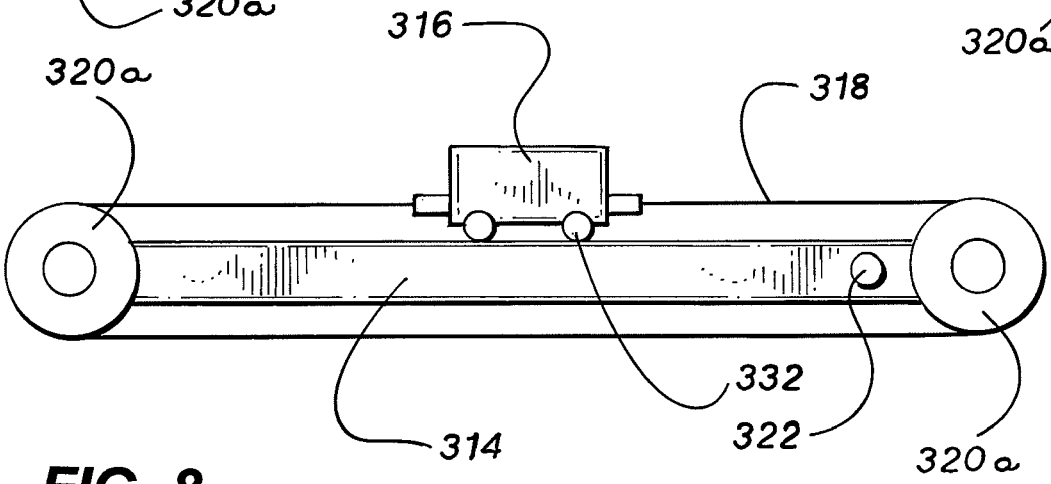
FIG. 8
FIG. 9
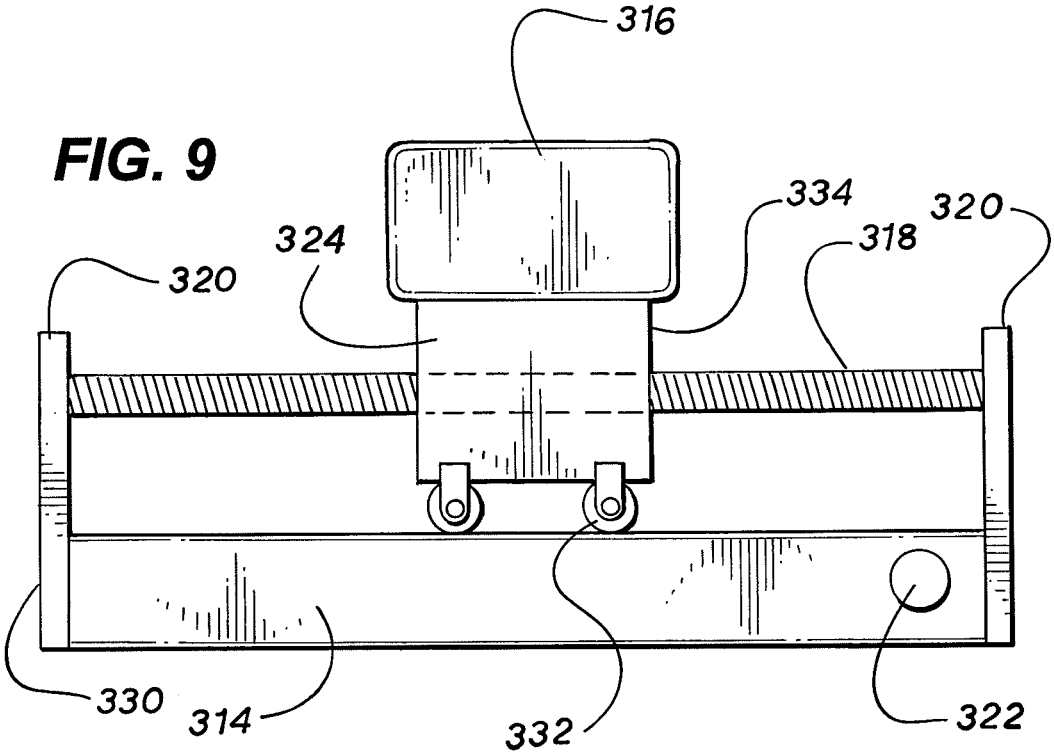

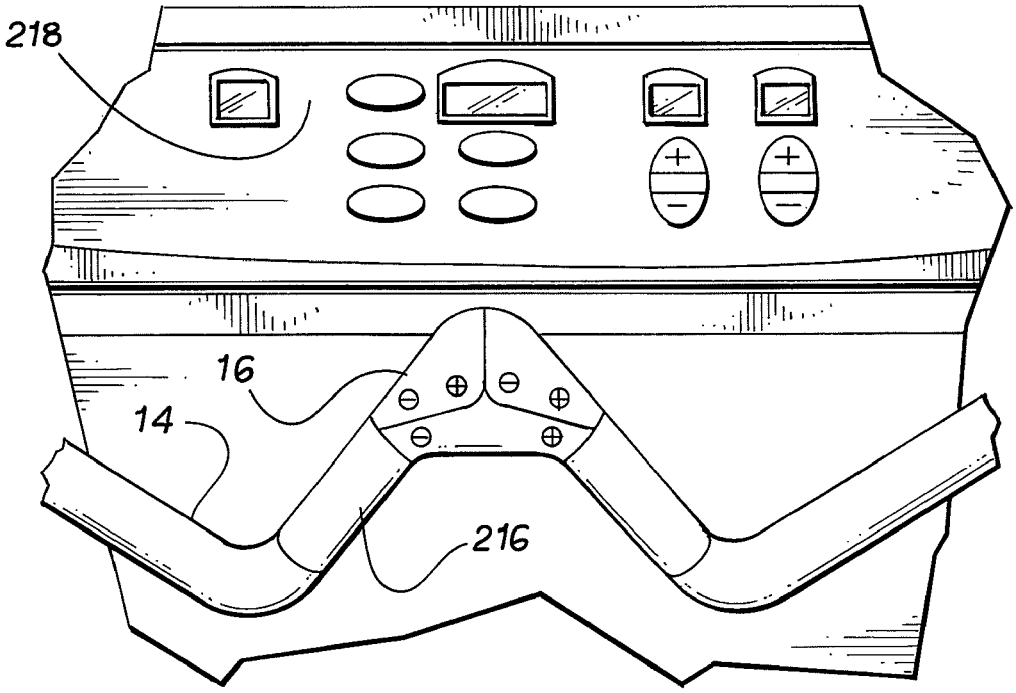
FIG. 13
FIG. 14
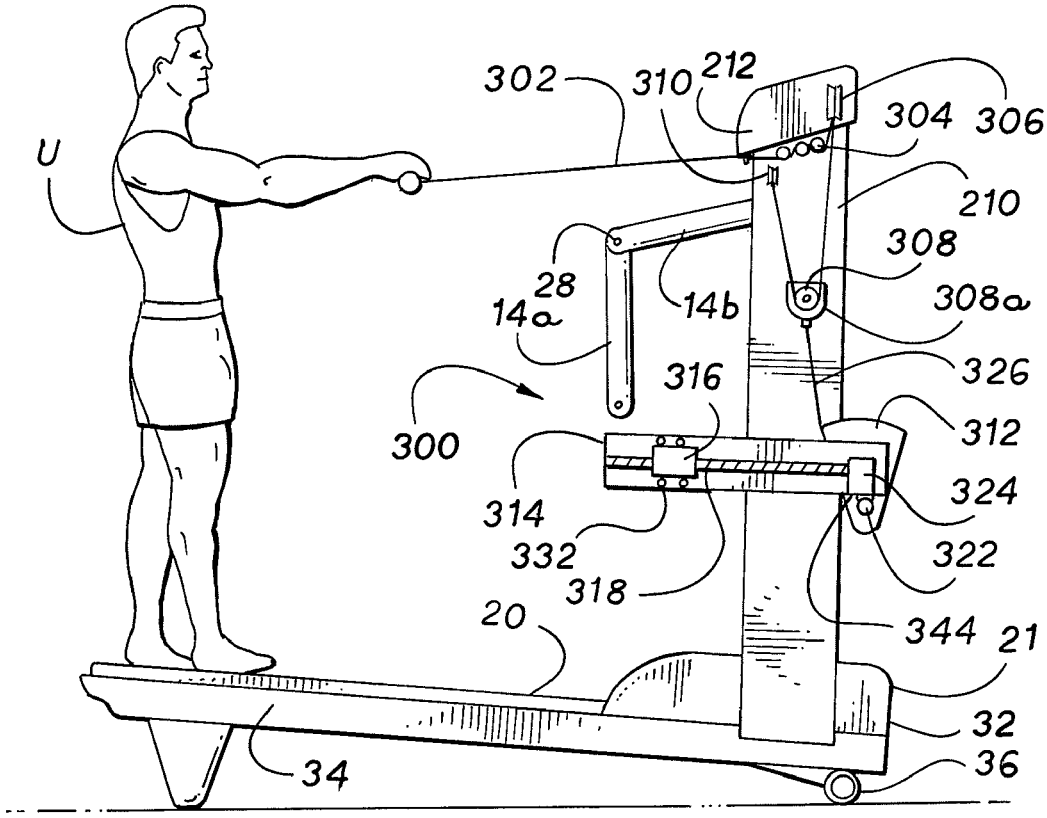

DUAL DIRECTION EXERCISE TREADMILL FOR SIMULATING A DRAGGING OR PULLING ACTION WITH A USER ADJUSTABLE CONSTANT STATIC WEIGHT RESISTANCE

BACKGROUND OF THE INVENTION

1. Technical Field

This invention relates to the general technical field of exercise, physical fitness and physical therapy equipment and machines and to the more specific technical field of treadmills that can be operated in a rearward walking and running mode to simulate a reverse dragging and pulling exercise. This invention also relates to the more specific technical field of using a weight resistance mechanism to generate a constant static weight resistance for simulating the dragging and pulling of a load, which weight resistance can be adjusted (increased and decreased) while exercising.

2. Prior Art

Exercise, physical fitness and physical therapy equipment and machines are available in various configurations and for various purposes, and are available for all of the major muscle groups. The majority of such equipment and machines, especially in the exercise field, concentrate either on an aerobic or anaerobic workout or on areas of the body such as the legs, the hips and lower torso, the chest and upper torso, the back, the shoulders and the arms.

Exercise treadmills are well known and are used for various purposes, including for walking or running aerobic-type exercises, and for diagnostic and therapeutic purposes. For the known and common purposes, the person (user) on the exercise treadmill normally can perform an exercise routine at a relatively steady and continuous level of physical activity, such as by maintaining a constant walking or running velocity and a constant incline, or at a variable level of physical exercise, such as by varying either or both the velocity and incline of the treadmill during a single session.

Exercise treadmills typically have an endless running surface extending between and movable around rollers or pulleys at each end of the treadmill. The running surface generally is a relatively thin rubber-like material driven by a motor rotating one of the rollers or pulleys. The speed of the motor is adjustable by the user or by a computer program so that the level of exercise can be adjusted to simulate running or walking.

The endless running surface, generally referred to as a belt, typically is supported along its upper length between the rollers or pulleys by one of several well known designs in order to support the weight of the user. The most common approach is to provide a deck or support surface beneath the belt, such as a plastic or metal panel, to provide the required support. A low-friction sheet or laminate, such as TEFLON® brand of synthetic resinous fluorine-containing polymers, can be provided on the deck surface (or indeed can be the material of construction of the deck surface) to reduce the friction between the deck surface and the belt.

Many current exercise treadmills, especially the middle to upper quality or feature level of exercise treadmills, also have the ability to provide a adjustable incline to the treadmill. The incline is accomplished in one of two manners—either the entire apparatus is inclined or just the walking and running surface is inclined. Further, the inclination can be accomplished by either manual or power driven inclination systems, and can be accomplished either at the command of the user or as part of a computerized exercise regimen programmed into the exercise treadmill. An inclination takes advantage of the fact that the exercise effort, or aerobic effect, can be varied with changes in inclination, requiring more exertion on the part of the user when the inclination is greater.

Most known exercise treadmills are structured to allow the user to walk or run in a forward direction, with the belt traveling in a direction that simulates walking or running forward; that is, the belt runs across the top of the deck in a front to back motion. Additionally, the inclination mechanisms in most exercise treadmills are structured to allow the user to walk or run in a level or uphill inclination; that is, the front of the deck can be level with the back of the deck or can be raised relative to the back of the deck to simulate an uphill inclination. Further, the hand rails and controls in most exercise treadmills are structured to complement simulated forward motion and are fixedly attached to the treadmill base.

However, with the exception of this inventor's inventions, this inventor is unaware of any specific exercise treadmill that is structured to allow the user to comfortably simulate a dragging or pulling motion; that is, a backwards walking motion either on a level plane or uphill. Additionally, with the exception of this inventor's inventions, this inventor is unaware of any specific exercise treadmill that provides a constant static weight resistance against dragging or pulling so as to simulate dragging or pulling of a load, which weight resistance can be varied (increased and decreased) by the user. A simulated dragging or pulling motion can be useful for exercising and developing different groupings of muscles and for providing an aerobic workout. Thus it can be seen that an exercise treadmill simulating a dragging or pulling motion would be useful, novel and not obvious, and a significant improvement over the prior art. It is to such an exercise treadmill that the current invention is directed.

BRIEF SUMMARY OF THE INVENTION

The present invention is a cardiovascular cross training device that addresses many needs not met with the current industry offering of treadmills, elliptical devices, stationary bicycles, and stepping devices. Backward walking is incorporated into the fitness and physical rehabilitation programs prescribed by many professional fitness trainers, physical therapists, sports medicine professionals and strength and conditioning professionals. Additionally, many athletes use weight loaded sled dragging (such as a hand held horizontal load) to augment their lower body strength training as well as their overall aerobic and anaerobic conditioning programs. The present invention combines these features.

The muscle activity of the lower body is much greater in backward walking versus forward walking and the heart rate is elevated 30% to 35% higher over the same forward walking speed. Thus, a person can expend more energy in a shorter period of time walking backwards. Adding the additional load factor of a hand held horizontal resistance (that is, a simulated dragging or pulling motion) and the energy expenditure and muscle loading to the lower body is increased. This increased energy output allows an individual to achieve and maintain their desired heart rate walking or running at a fraction of the speed of any forward motion oriented exercise.

Further, the overall force of impact on the legs and body is reduced at a backward walk versus forward motion oriented exercises due to the reduced stride length, foot pattern contact and lower extremity kinematics pattern. The sheer force to the knees is reduced because the sheer force is reversed while walking backwards. Moreover, the range of motion of the knee joint is reduced to incorporating a nearly isometric pattern following contact compared to a more stressful eccentric loading. This can be very beneficial to the exercisers with knee joint injuries or those who experience knee pain during forward motion oriented exercises. Most knee joint injuries can even continue to heal during a backward walking training program. Hip joint stress is reduced during backward walking because the overall range of motion of the hip joint is reduced by incorporating greater hip flexation but much less hip extension.

During backward walking the hamstring muscles are stretched prior to activation and foot plant due to hip flexation. Given the prestretch, the load is not introduced until the weight bearing phase of the movement where the hamstring muscle is much more capable of accepting the load factors. Subsequently, it is more beneficial and less injury prone to add additional hand held horizontal resistance (actual or simulated dragging or pulling motion, hereinafter referred to collectively as a dragging motion or a backward dragging motion) to the ham string muscle in a backward walking motion. Therefore, during a backward dragging motion the user can achieve greater blood flow to and activation of the hamstring muscles at a slower walking speed than walking without the added load factor of the dragging motion.

The present invention is an exercise treadmill for simulating the dragging or pulling of an object on a level surface, up an incline or down a decline. The treadmill has a lower base having the treadmill surface and housing the internal mechanical components of the walking platform, a movable resistance arm or had grip controller, a fixed console support structure to which the resistance arm is attached and on which various control switches and displays are located, and a weight resistance mechanism located proximal to and illustratively on the side of the console support structure. In one embodiment, the weight resistance mechanism can be operatively connected to the resistance arm via a cable. In another embodiment, the weight resistance mechanism can be operatively connected to the resistance arm by lever, rods, or the like. In yet another embodiment, the weight resistance mechanism can be operatively directly connected to the resistance arm. In another embodiment, the hand grip controller can be operatively attached to the weight resistance mechanism via a cable that can pass through and can be operatively supported by the console support structure.

The movable resistance arm can be at least one section pivotally or otherwise movable connected to the fixed console support structure and operatively connected to the weight resistance mechanism via additional sections, linkages, and/or cables or the like. In this embodiment, the movable resistance arm can have a hand grip bar or portion and on which a hand controller can be mounted. Alternatively, the movable resistance arm can be a hand grip bar operatively connected to the weight resistance mechanism via additional sections, linkages, and/or cables or the like, but not necessarily connected to the fixed console support structure. Also alternatively, the movable resistance arm can be a hand grip bar operatively connected to the weight resistance mechanism via cables or the like, and not connected to the fixed console support structure, although the fixed console support can have a cable support device.

In reverse pulling or dragging operation, when a user steps onto the treadmill and grips the hand grip bar and starts the treadmill belt moving, the user begins to walk or run in a simulated backwards direction relative to the console support structure, causing the user to pull on the hand grip portion of the resistance arm in a pulling direction. Alternatively, the treadmill may be set up to begin to move automatically at a speed and at an inclination according to a value entered from the hand controller (which can either be on the resistance arm or can be on a hand grip controller) or on the control console. This pulling transfers from the resistance arm or hand grip controller, to the main cable or other connecting linkages and/or cables, which is or are operatively connected to the weight resistance mechanism, thus acting on the weight resistance mechanism. As disclosed above, the action of the resistance arm or hand grip controller on the weight resistance mechanism can be by many means, such as cables, wires, rods, levers, or the like, directly or indirectly, and structurally attached or in cooperative communication.

The weight resistance mechanism can be set by the user to a specific amount, such as for example 10 kilograms, comparable to known weight resistance mechanism such as weight stacks. Thus, when the user pulls on the movable resistance arm or hand grip, the weight resistance mechanism exerts a counterforce on the user of the set weight, 10 kilograms in this example. The counterforce is static and constant at the set weight throughout the entire range of movement of the movable resistance arm or hand grip, except in some embodiments at the very start of the range of motion when the weight resistance mechanism is resting on a stop. That is, the weight resistance mechanism exerts a counterforce on the user of the set weight, 10 kilograms in this example, whether the user has pulled the movable resistance arm or hand grip one centimeter or one meter, and this set weight is static and constant, at 10 kilograms in this example, unless the weight resistance mechanism is reset to a different amount. Thus, the degree of weight resistance of the weight resistance mechanism can be controlled by the user to simulate dragging or pulling a weight such that the exercise regimen is similar to walking or running backwards while dragging or pulling an object of a weight comparable to the setting of the weight resistance mechanism. The higher the setting of the weight resistance mechanism, the heavier the simulated object being pulled. The degree of weight resistance also is adjustable in that the user can set the specific amount of weight resistance to any amount within the parameters of the weight resistance mechanism structure prior to and during the exercise regimen, depending on the embodiment of the invention.

In a preferred embodiment, the weight resistance mechanism is a moment arm mechanism comprising a moment arm, an adjustable weight, and a drive mechanism for moving the adjustable weight relative to or along the moment arm. As the adjustable weight is adjusted along the moment arm relative to a pivot point of the moment arm, the weight resistance of the moment arm is increased or decreased, thus simulating the dragging or pulling of various or varying load weights. The moment arm is operatively connected to the movable resistance arm via the main cable, thus transferring the weight resistance effect to the user. Thus, when the user pulls on the movable resistance arm or hand grip, or hand grip controller, so as to activate the moment arm, the moment arm creates a constant and static counterforce equivalent to the specific weight amount set by the user.

In other preferred embodiments, the weight resistance mechanism is a pneumatic mechanism comprising a pneumatic cylinder, an air compressor, and various connecting hoses. In known pneumatic mechanisms, the resistance of the pneumatic cylinder can be set to certain values corresponding to a known weight resistance by the setting of the compressor (the higher the pressure of the compressed air produced by the compressor, the higher the resistance of the pneumatic cylinder, and the higher the equivalent weight resistance). Similarly, the weight resistance mechanism can be a hydraulic cylinder and the air a fluid.

In still other preferred embodiments, the weight resistance mechanism is an electric motor and clutch braking system comprising an electric motor and a clutch assembly. In known systems of this type, the electric motor imparts a force through the clutch brake to the movable resistance arm or hand grip, which can correspond to a known weight resistance by the power supplied to the motor or to the clutch brake. Pulling on the movable resistance arm or hand grip, or hand grip controller, causes a force in a rotational direction counter to the rotational direction of the motor and clutch brake, creating a counterforce that can be measured in an equivalent weight resistance.

The invention also can be a combination of a conventional treadmill and the reverse dragging motion treadmill. To accomplish this, the hand controller and movable resistance arm or hand grip controller can be set in a locked position for conventional treadmill operation and set in an unlocked position for reverse dragging operation. Further, the lower base housing the treadmill belt motor and the weight resistance mechanism can be a relatively larger structure sitting under and supporting the invention or a relatively smaller structure from which the treadmill belt and platform extend. In the first instance, the elevation motor or means for raising and lowering the treadmill belt platform for incline and decline operation can be located within the lower base housing. In the second instance, the elevation motor or means can be located in a separate relatively smaller structure attached to the end of the treadmill platform opposite the end of the treadmill platform attached to the lower base housing.

Generally speaking, the internal mechanical components of the treadmill are similar to (or can be similar to or the same as) the internal mechanical components of known treadmills. The treadmill comprises an endless belt looped about rollers or pulleys so as to provide a platform on which the user can stand, walk and/or run. A deck below a portion of the belt supports the belt and the user. A belt motor cooperates with the belt and/or the rollers or pulleys to move the belt, thus creating a moving platform on which the user can walk or run for the exercise regimen. An incline motor cooperates with the platform, the deck, the rollers or pulleys or rear legs to incline the belt to simulate a hill.

These features, and other features and advantages of the present invention will become more apparent to those of ordinary skill in the art when the following detailed description of the preferred embodiments is read in conjunction with the appended figures.

BRIEF DESCRIPTION OF THE DRAWINGS

FIG. 2 is a side view, partly in section, of the invention operating in reverse dragging/pulling mode in a level position, showing a first embodiment of the moment arm weight resistance mechanism and a three-section resistance arm.

FIG. 3 is a side view, partly in section, of the invention operating in reverse dragging/pulling mode in an inclined position, showing a second embodiment of the moment arm weight resistance mechanism and a five-section resistance arm.

FIG. 7 is a top view of an alternate embodiment of the moment arm weight resistance mechanism of the invention.

FIG. 8 is a side view of the alternate embodiment of the moment arm weight resistance mechanism shown in FIG. 7.

FIG. 9 is a side view of another alternate embodiment of the moment arm weight resistance mechanism of the invention.

FIG. 13 is a perspective view of a representative control console and hand controller for the invention.

FIG. 14 is a side view, partly in section, of the invention operating in reverse dragging/pulling mode in an inclined position, showing a hand grip controller portion with an unrestricted range of motion detached from the rest of the resistance arm.

DETAILED DESCRIPTION OF THE PREFERRED EMBODIMENTS

Figure 1:
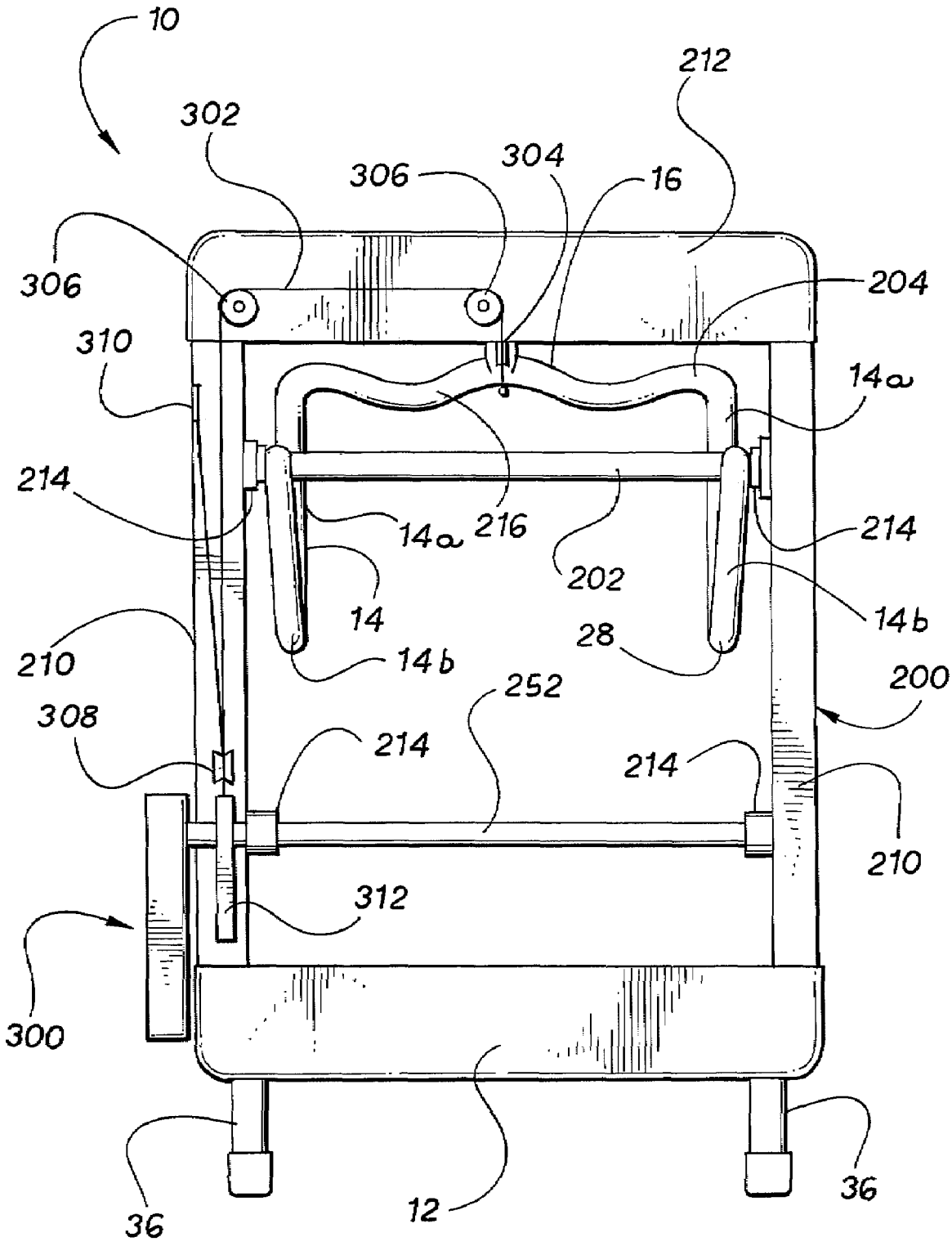
FIG. 1 is a front view, partly in section, of the invention.
Figure 4:
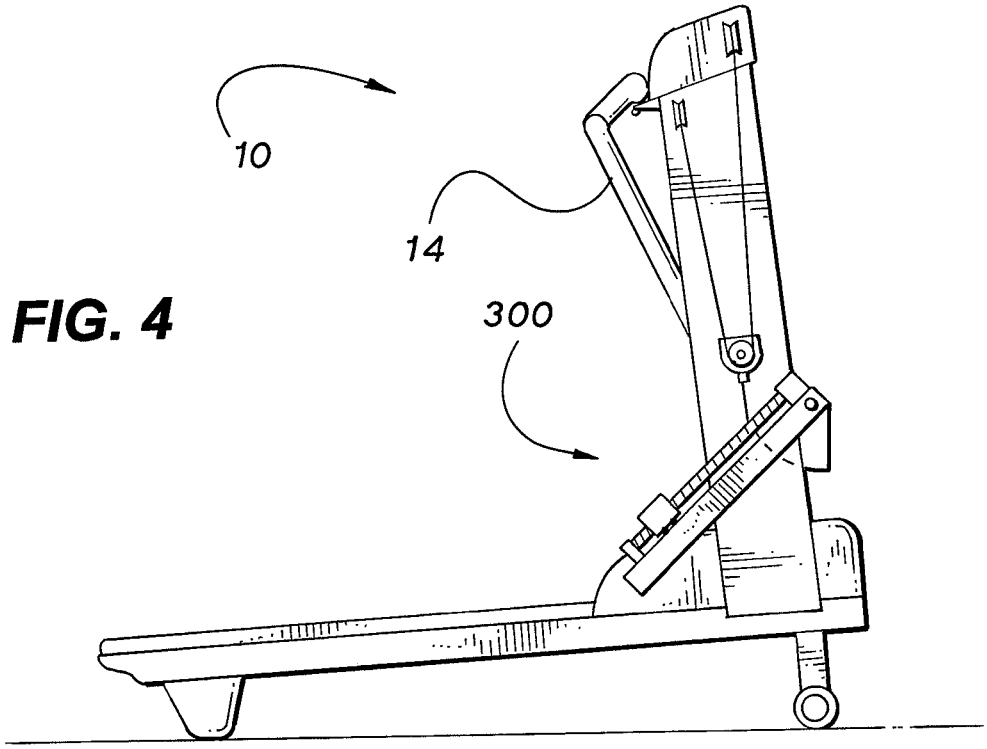
FIG. 4 is a side view, partly in section, of the invention operating in forward walking/running mode.

Referring now to the appended figures, the invention will be described in connection with representative preferred embodiments. FIG. 1 is a front view of the invention. FIG. 2 is a side view of the invention operating in reverse dragging/pulling mode in a level position, showing a first embodiment of the moment arm weight resistance mechanism and a three-section resistance arm. FIG. 3 is a side view of the invention operating in reverse dragging/pulling mode in an inclined position, showing a second embodiment of the moment arm weight resistance mechanism and a five-section resistance arm. FIG. 4 is a side view of the invention operating in forward walking/running mode.

Figure 5:
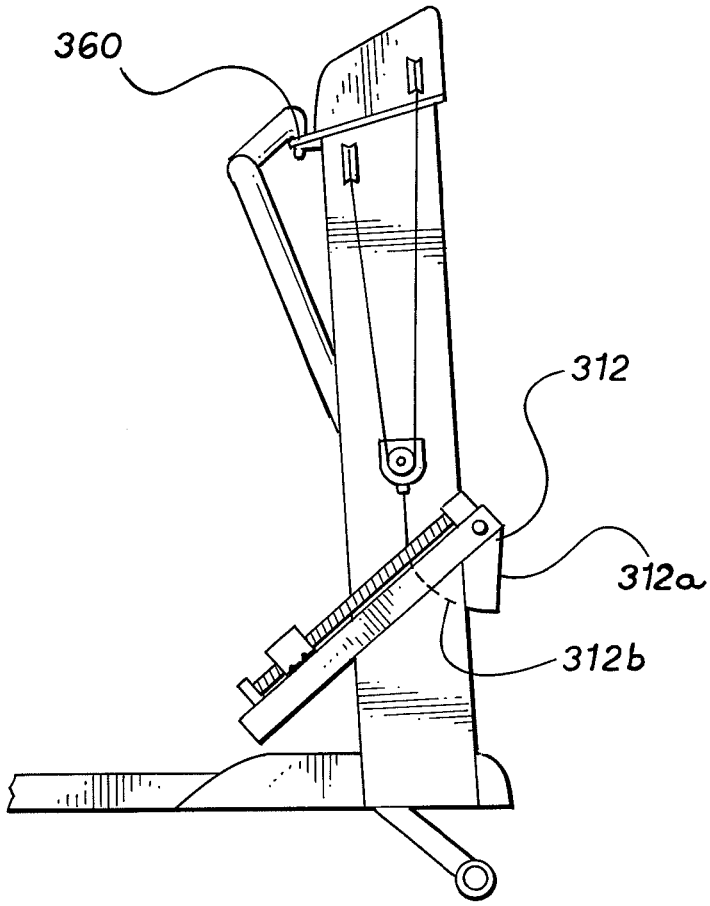
FIG. 5 is a side view, partly in section, of the moment arm weight resistance mechanism in the resting position.
Figure 6:
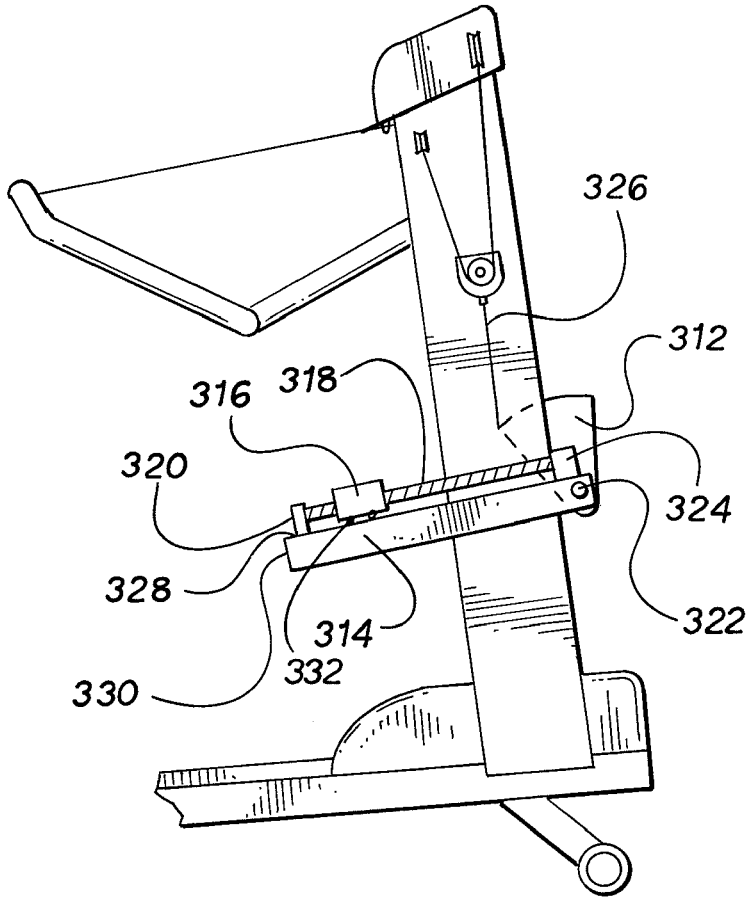
FIG. 6 is a side view, partly in section, of the moment arm weight resistance mechanism in a resistance position.
Figure 10:
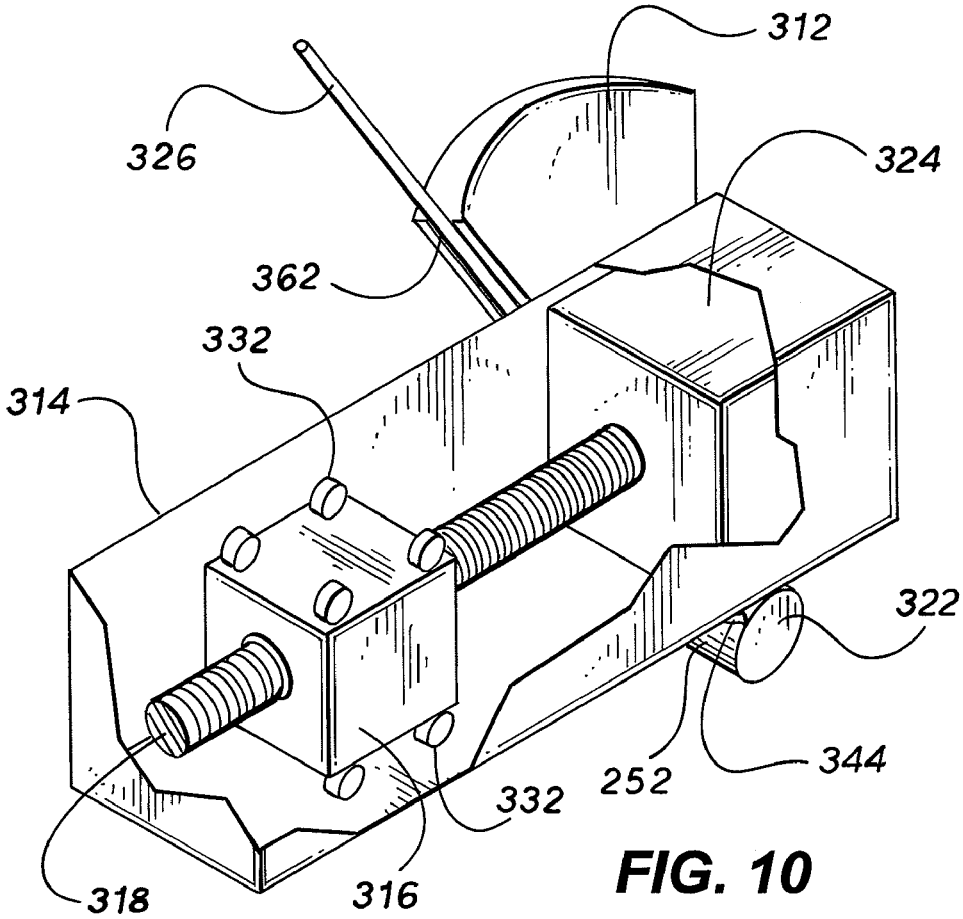
FIG. 10 is a sectional perspective view of the second embodiment of the moment arm weight resistance mechanism shown in FIG. 3 in larger detail.

FIG. 5 is a side view of the moment arm weight resistance mechanism in the resting position. FIG. 6 is a side view of the moment arm weight resistance mechanism in a resistance position. FIG. 7 is a top view of an embodiment of the moment arm weight resistance mechanism of the invention. FIG. 8 is a side view of the embodiment of the moment arm weight resistance mechanism shown in FIG. 7. FIG. 9 is a side view of an alternate embodiment of the moment arm weight resistance mechanism of the invention. FIG. 10 is a sectional side view of the second embodiment of the moment arm weight resistance mechanism shown in FIG. 3 in larger detail.

Figure 12:
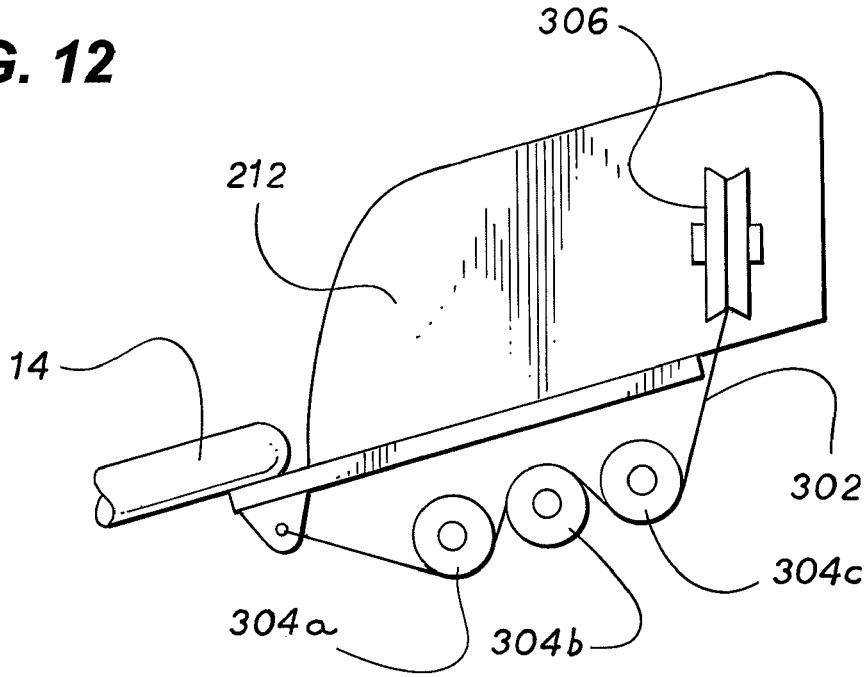
FIG. 12 is a side view of the internal pulley and cable configuration between the resistance arm and the moment arm weight resistance mechanism.
Figure 11:
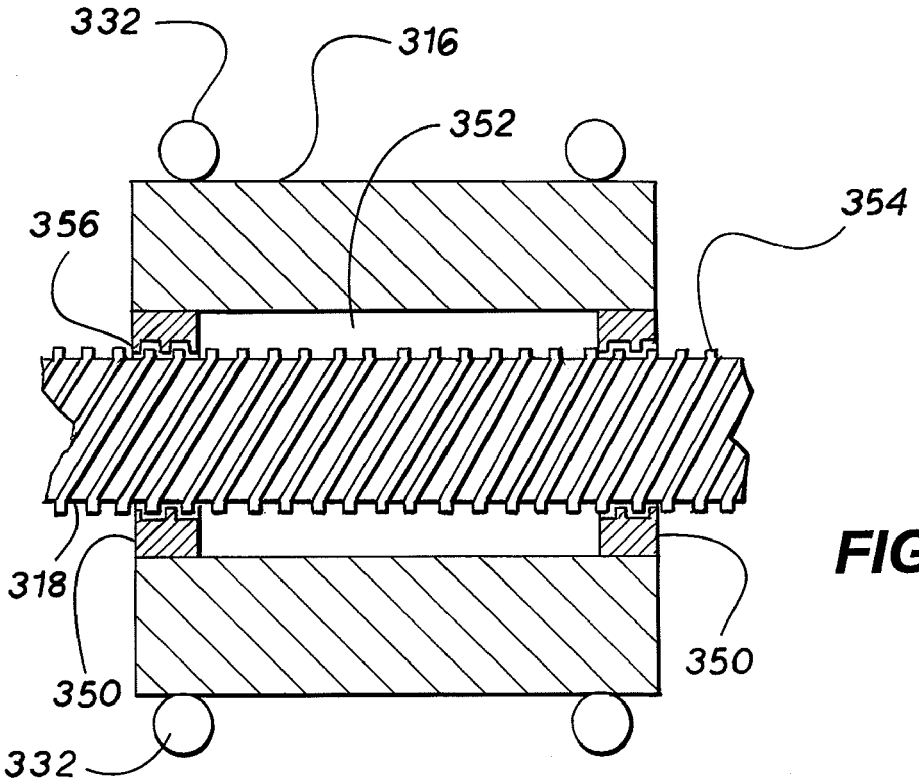
FIG. 11 is a sectional side view of a weight and weight adjusting drive that can be used with the present invention.

FIG. 11 is a sectional side view of a representative weight and weight adjusting drive that can be used with the present invention. FIG. 12 is a side view of the internal pulley and cable configuration between the resistance arm and the moment arm mechanism. FIG. 13 is a view of a representative control console and hand controller for the invention. FIG. 14 is a side view, partly in section, of the invention operating in reverse dragging/pulling mode in an inclined position, showing a hand grip portion, which has an unlimited range of motion due to a flexible cable connection, detached from the rest of the resistance arm.

Figure 15:
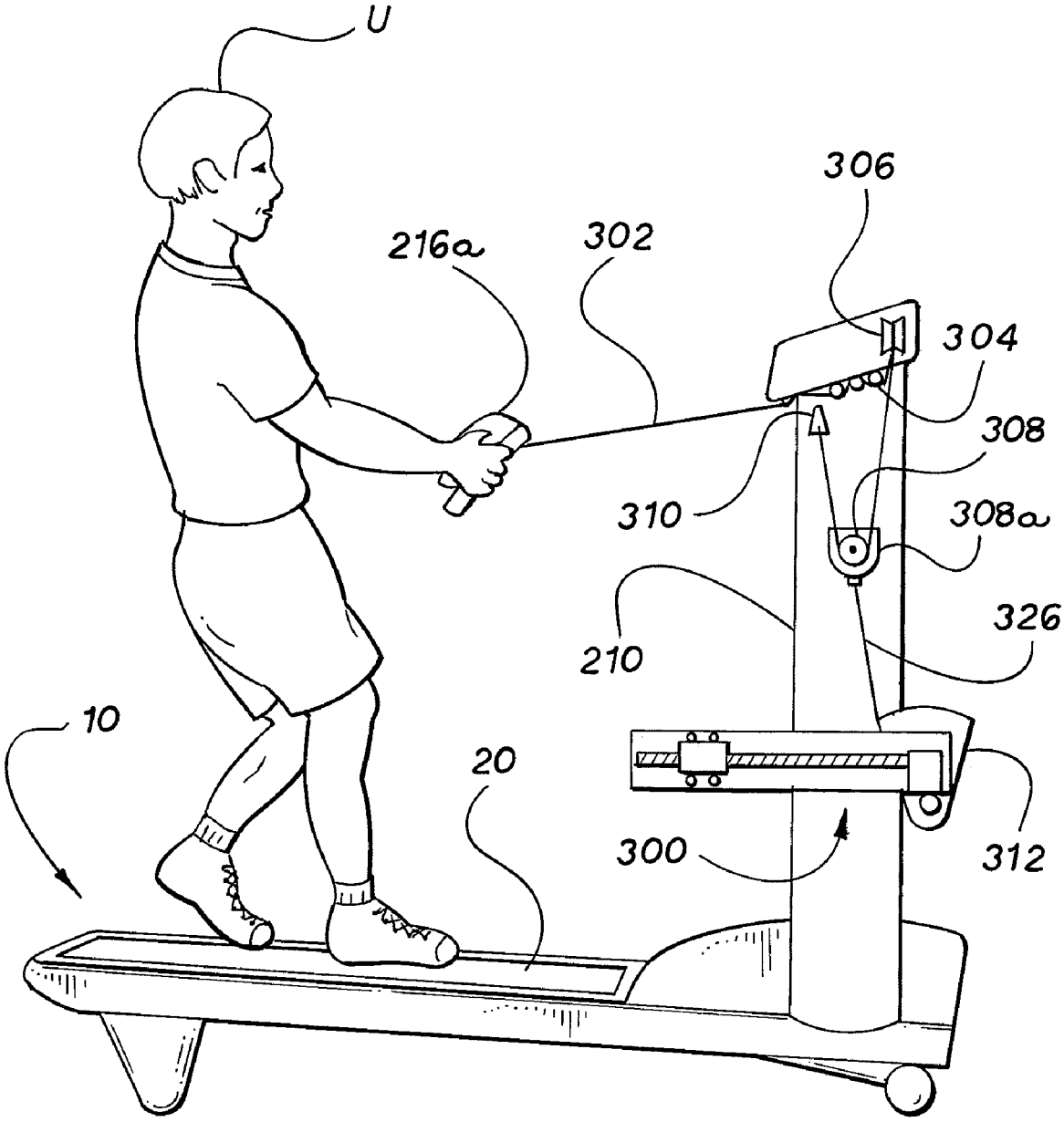
FIG. 15 is a side view, partly in section, of the invention operating in reverse dragging/pulling mode in an inclined position, showing a first embodiment of the moment arm weight resistance mechanism and a hand grip controller operatively connected to the weight resistance mechanism via a cable.
Figure 16:
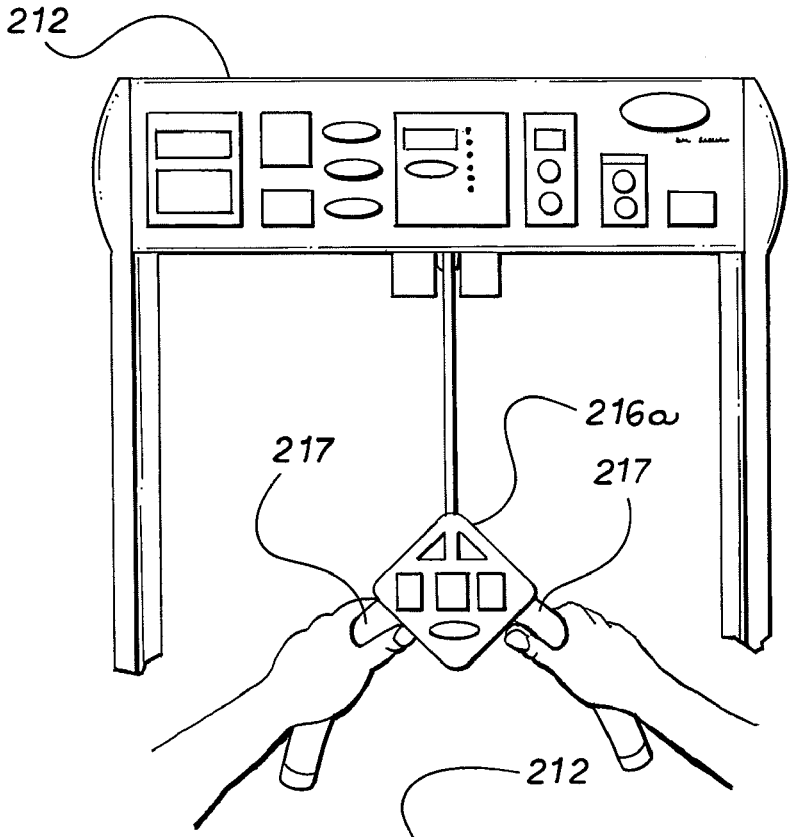
FIG. 16 is a top view of an embodiment of the invention having a movable hand grip controller operatively connected to the weight resistance mechanism and a separate fixed control console.
Figure 17:
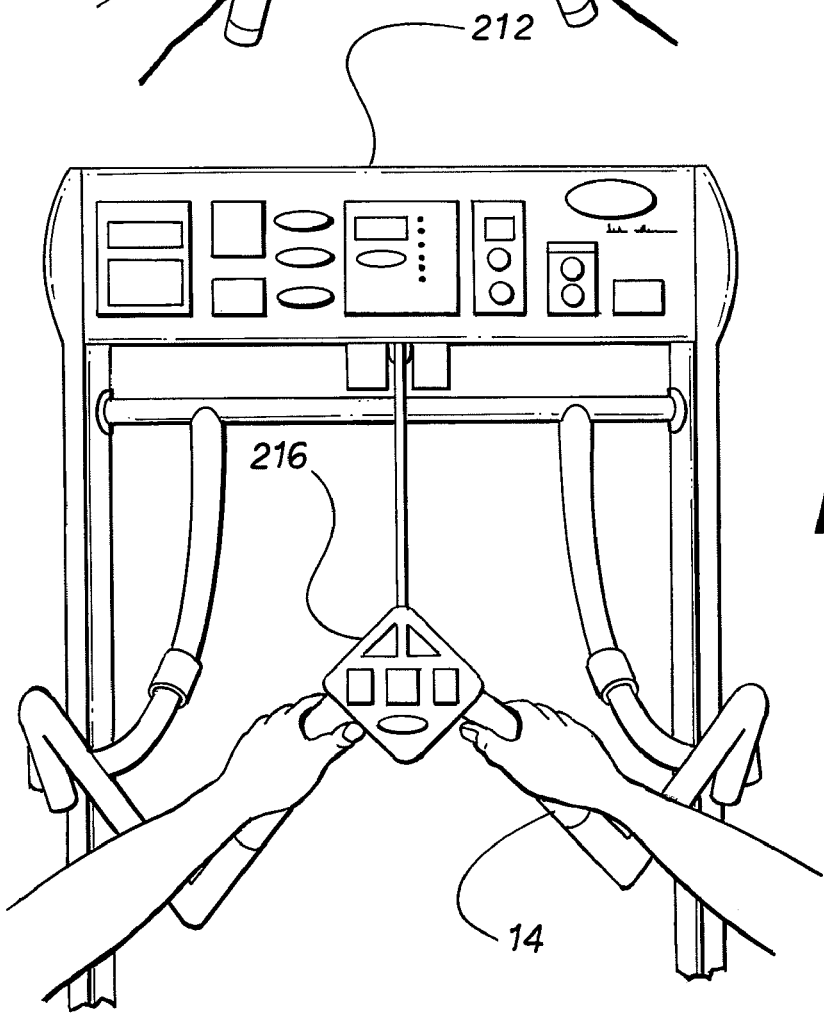
FIG. 17 is a top view of an embodiment of the invention showing controller features both on the movable resistance arm and the fixed console controller.

FIG. 15 is a side view, partly in section, of the invention operating in reverse dragging/pulling mode in an inclined position, showing a first embodiment of the moment arm weight resistance mechanism and a hand grip or hand grip controller operatively attached to the weight resistance mechanism only via a flexible cable so as to have a freer range of motion, without resistance arm sections or linkages. FIG. 16 is a top view of an embodiment of the invention having a movable hand grip or hand grip controller operatively connected to the weight resistance mechanism and a fixed control console, illustrating the distinction between the movable hand grip controller and the fixed or unmovable console control. FIG. 17 is a top view of an embodiment of the invention showing controller features both on the movable resistance arm and the fixed console controller.

Figure 18:
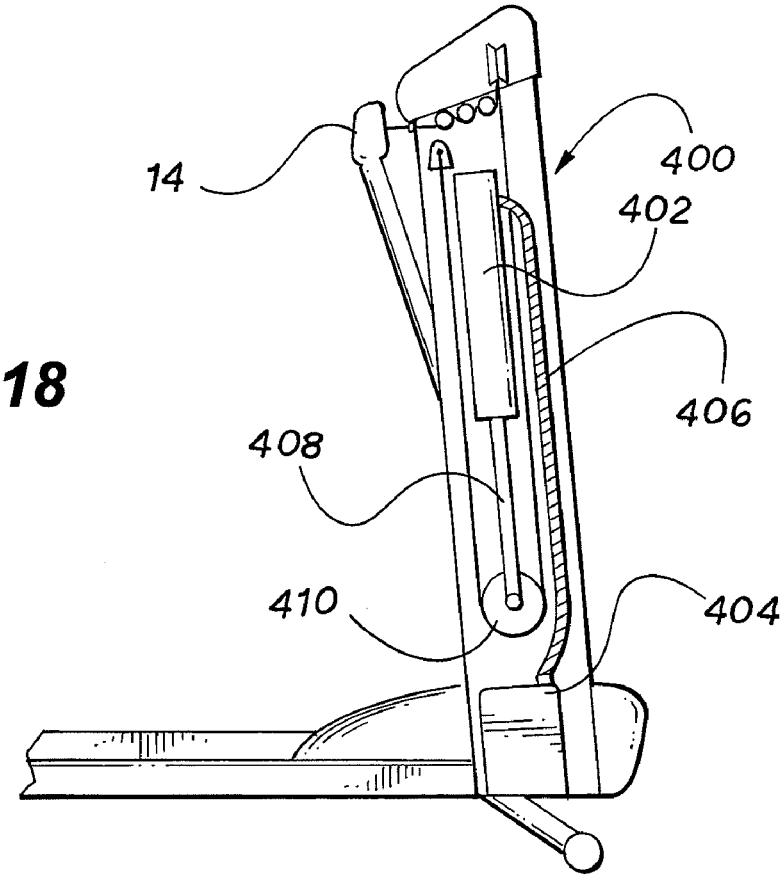
FIG. 18 is a side view, partly in section, of an alternate pneumatic weight resistance mechanism in the resting position.
Figure 19:
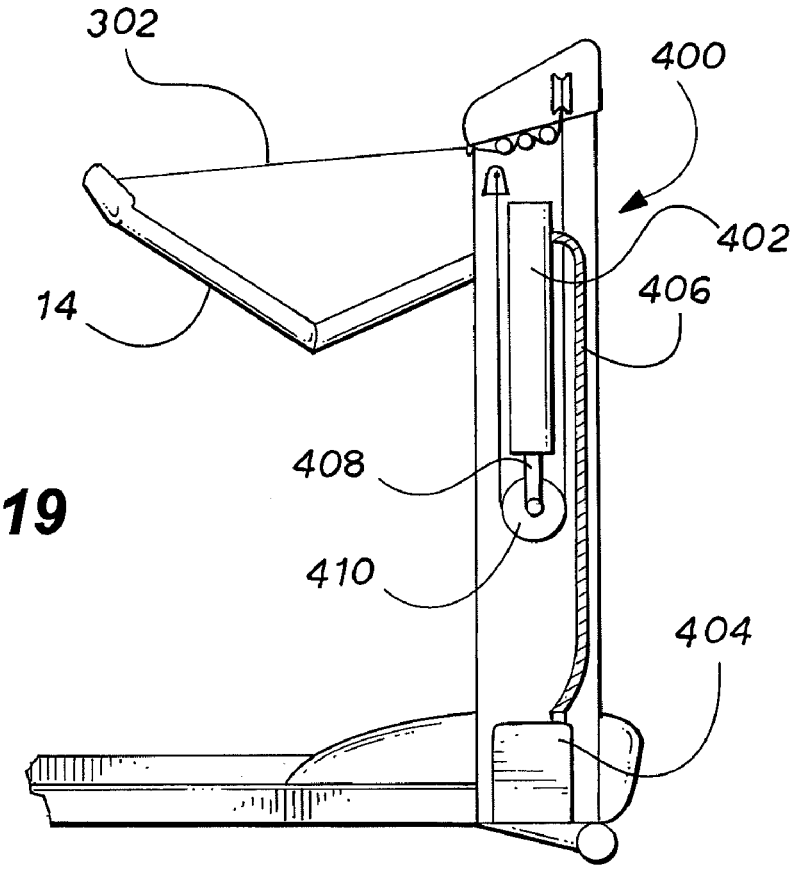
FIG. 19 is a side view, partly in section, of the alternate pneumatic weight resistance mechanism in a partially extended resistance position.
Figure 20:
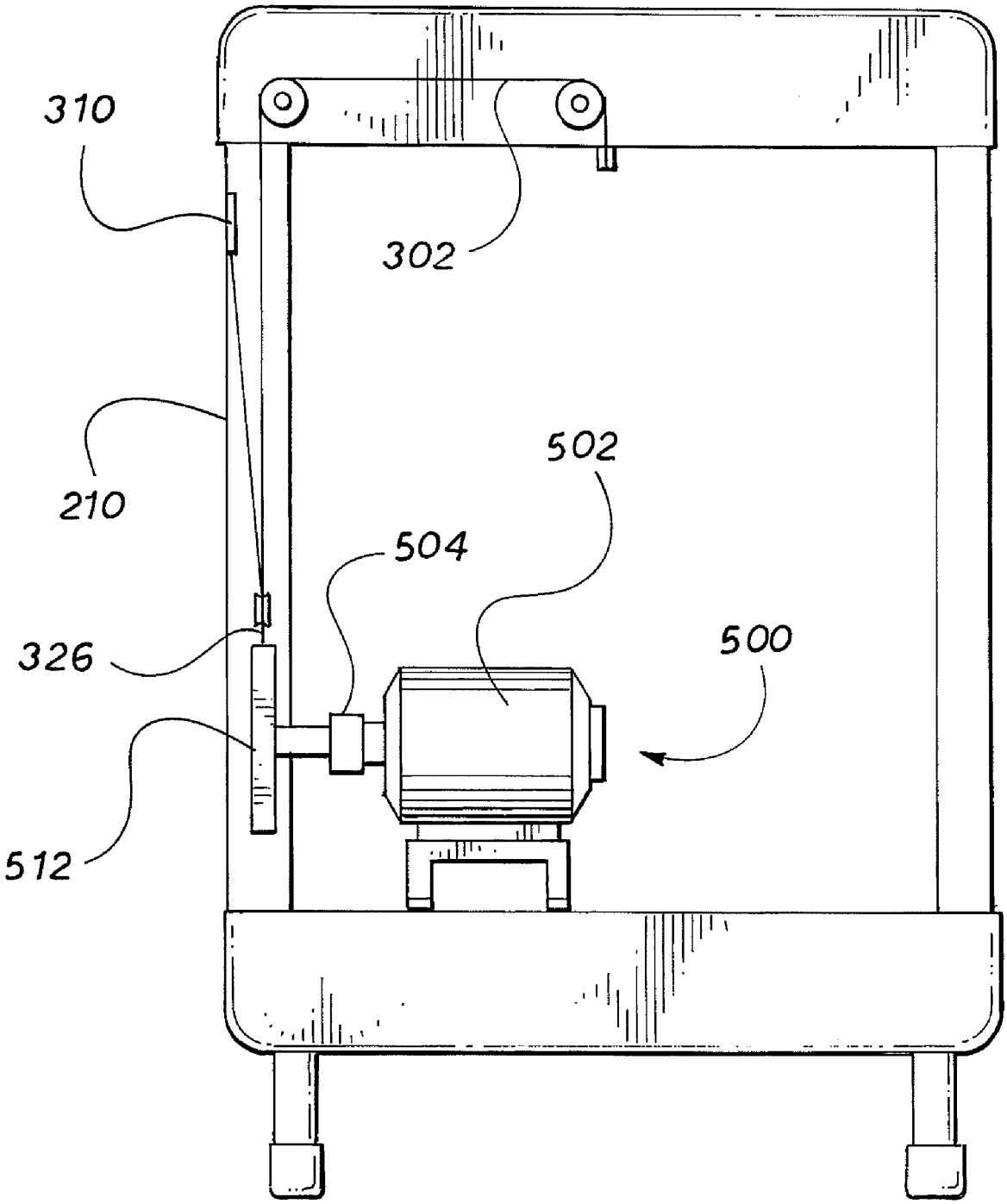
FIG. 20 is a front view, partly in section, of an alternate electric motor clutch brake weight resistance mechanism.

FIG. 18 is a side view, partly in section, of an alternate pneumatic or hydraulic weight resistance mechanism in the resting position. FIG. 19 is a side view, partly in section, of the alternate pneumatic or hydraulic weight resistance mechanism in a partially extended resistance position. FIG. 20 is a front view, partly in section, of an alternate electric motor clutch brake weight resistance mechanism.

FIG. 1 is a front view of one embodiment of the invention structured with a moment arm as the exemplary weight resistance mechanism and illustrating the relationship between the various major components of the device. Treadmill 10 has a lower base 12 housing the internal mechanical components of treadmill 10. Projecting upwardly from base 12 is console support structure 200 to which resistance arm pivot rod 202 and moment arm pivot rod 252 are pivotally connected or supported. Resistance arm 14, on which hand controller 16 is mounted, is operatively connected to resistance arm pivot rod 202. Moment arm weight resistance mechanism 300 is operatively connected to moment arm pivot rod 252.

Console support structure 200 preferably is fixedly attached to base 12 and comprises two uprights 210 that are secured to base 12 at or along the sides of base 12 at points proximal to the front end of base 12 (see FIG. 2). Console 212 extends generally horizontally between uprights 210 and preferably is located at or proximal to the top of uprights 210. Thus, console 212 in a preferred embodiment is fixedly attached to console support structure 200 and is considered unmovable or at least not movable as part of the exercise regimen.

Resistance arm pivot rod 202 preferably is movably attached to the console support structure 200 and extends generally horizontally between uprights 210 and is pivotally attached to each upright 210, thus allowing resistance arm pivot rod 202 to rotate axially between uprights 210. Bearings 214 are one means by which resistance arm pivot rod 202 can be rotationally secured or journaled to uprights 210. As can be seen in FIG. 1, resistance arm pivot rod 202 is mounted more proximal to the top of uprights 210, that is, more proximal to console 212. Although this mounting location is generally arbitrary, this location has been found to be preferable from an ergonomic standpoint in that this location generally mimics the location and position (height) of the user's upper body, arms and shoulders and allows for a more comfortable pulling or dragging motion.

Moment arm pivot rod 252 also extends generally horizontally between uprights 210 and can be pivotally attached to each upright 210, thus allowing moment arm pivot rod 252 to rotate axially generally between uprights 210. Bearings 214 are one means by which moment arm pivot rod 252 can be rotationally secured or journaled to uprights 210. Bearings 214 can be attached directly to uprights 210 or can be mounted on uprights 210 via brackets or the like. For example, in some circumstances, it can be advantageous to mount moment arm pivot rod 252 in front of console support structure 200 rather than directly between uprights 210. In such an embodiment, additional brackets would support bearings 214 at a position in front of uprights 210, that is, at a position on the opposite side of uprights 210 from user U and treadmill belt 20, or at a position behind uprights 210, that is, at a position on the same side of uprights 210 as user U and treadmill belt 20. One end of moment arm pivot rod 252 can extend though one of the bearings 214 and through one of the uprights 210 such that moment arm pivot rod 252 can be operatively connected to moment arm weight resistance mechanism 300. Alternatively, if moment arm pivot rod 252 is mounted in front of console support structure 200, then moment arm pivot rod 252 would pass in front of and not through upright 210, as can be seen in FIGS. 2-6. As can be seen in FIG. 1, moment arm pivot rod 252 is mounted more proximal to the bottom of uprights 210, that is, more proximal to base 12. Although this location is generally arbitrary, this location has been found to be preferable from a mechanics standpoint in that this location allows the moment arm weigh resistance mechanism to be mounted lower on the treadmill 10, thus providing a lower center of gravity and greater stability for the treadmill 10.

Resistance arm 14 can comprise one, two, three or more resistance arm sections, and preferably three or five resistance arm sections, which include hand grip portion 216 as a section. As illustrated in FIGS. 1 and 2, resistance arm 14 comprises three resistance arm sections, a single generally U-shaped upper resistance arm 14A, which includes hand grip portion 216, and two lower resistance arms 14B. As illustrated in FIG. 3, resistance arm 14 comprises five resistance arm sections, a single hand grip portion 216, two upper resistance arms 14A, and two lower resistance arms 14B. Lower resistance arms 14B can be rod-like, tubular, flat rigid or semi-rigid structures, or the equivalent, that are securely connected to, and extend normal from, resistance arm pivot rod 202.

In the embodiment shown in FIGS. 1 and 2, upper resistance arm 14A is a generally U-shaped rod or tubular structure that comprises hand grip portion 216 and that is pivotally or hingedly connected to both of, and extends between, lower resistance arms 14B via hinges 28. In the embodiment shown in FIG. 3, hand grip portion 216 is separate from upper resistance arm 14A and is pivotally or hingedly connected to both of, and extends between, upper resistance arms 14A via hinges 28A. Both upper resistance arms 14A and lower resistance arms 14B can be rod-like, tubular, flat rigid or semi-rigid structures, or the equivalent, that are hingedly connected to each other via hinges 28. Lower resistance arms 14B are securely connected to, and extend normal from, resistance arm pivot rod 202. The actual shape or curvature of the hand grip portion 216 and of the upper resistance arm 14A can be selected by the manufacturer and can be as simple as a curved or flattened U to having more complex ergonomically curved hand grip portions 216 as shown in FIG. 1.

Lower resistance arms 14B are attached to resistance arm pivot rod 202 preferably at locations proximal to bearings 214 and uprights 210, such that operational movement of lower resistance arms 14B causes resistance arm pivot rod 202 to rotate axially (within bearings 214 in the illustrative embodiment shown in FIG. 1) about its axis, which, as disclosed herein, actuates moment arm weight resistance mechanism 300. Upper resistance arm 14A is (as disclosed in connection with FIGS. 1 and 2), or upper resistance arms 14A are (as disclosed in connection with FIG. 3), pivotally or hingedly (or any other equivalent means of attachment) attached to lower resistance arms 14B such that upper resistance arm or arms 14A can pivot or fold towards and away from lower resistance arms 14B. Preferably, the pivoting or folding angle between upper resistance arm 14A and lower resistance arms 14B is limited via a stop mechanism structure (not shown) built into or attached to or between upper resistance arm or arms 14A and/or lower resistance arms 14B so as to prevent the resistance arm 14 from interfering with the functional operation of the invention. Upper resistance arm or arms 14A and/or lower resistance arms 14B can have a curvature or other non-linear shape to allow proper folding operation.

The use of pivotally connected upper resistance arm or arms 14A and lower resistance arms 14B, and hand grip portion 216 (as disclosed in connection with FIG. 3) allows resistance arm 14 to be self-aligning for users U of different heights and body builds. Additionally, the use of a three-part or five-part resistance arm 14, or another multi-part resistance arm 14, provides for a more biometrically acceptable pulling motion and to position resistance arm 14 as far away from user U as possible to avoid incidental and unwanted contact with resistance arm 14. Further, the use of a three-part or five-part resistance arm 14, or another multi-part resistance arm 14, can be more comfortable to user U.

Hand controller 16 is mounted generally towards the center of hand grip portion 216 of upper resistance arm 14A, which also is proximal to user U when user U is in the correct position for operating the treadmill 10. The combination of hinges 28, 28A and the rotation of resistance arm pivot rod 202 allows desired motion of resistance arm 14 and hand controller 16 relative to user U. The use of a movable hand grip portion 216 comprising a hand controller 16 for operating the treadmill 10, rather than the common use of a stationary or fixed control console, allows the user to maintain more convenient control of the operation of the treadmill 10 during the backwards dragging motion as, unlike in a conventional forward movement treadmill, the user is effectively attempting to move away from the control console rather than towards the control console. Further, unlike in a conventional forward movement treadmill where the user either needs no additional support and merely needs to be able to reach the control console when changing speed or inclination, or needs additional support from being thrown backwards off of the treadmill due to the motion of the endless belt, and therefore has no need for a movable resistance arm 14, hand grip portion 216, or hand controller 16, on the present treadmill 10, the user is required to maintain a grip on a portion of the device to effect the dragging motion, and the use of a fixed hand grip would not allow the activation of the weight resistance mechanism 300. The movable hand controller 16 solves the problem of allowing the user to activate the weight resistance mechanism 300 and control the weight resistance mechanism 300 and the treadmill 10, while at the same time maintain a position on the treadmill 10 and conduct the exercise regiment by pulling against an adjustable but constant and static weight resistance.

FIG. 2 is a side view of the treadmill 10 showing user U operating the treadmill 10 in a flat or level dragging or pulling simulation with a partial resistance arm 14 extension. In this position, user U is simulating a level surface dragging or pulling motion and is walking or running backwards and pulling on resistance arm 14, and thus pulling against moment arm weight resistance mechanism 300. FIG. 2 shows a first embodiment of the moment arm weight resistance mechanism 300 and a three-section resistance arm 14 in which the hand grip portion 216 is a part of the single upper resistance arm 14A. As can be seen, the multi-part structure of resistance arm 14 allows the appropriate motion of resistance arm 14 and hand controller 16 relative to user U for self-alignment of the resistance arm 14 and for proper and comfortable operation of treadmill 10. Moment arm weight resistance mechanism 300 is shown in an operating position, meaning moment arm weight resistance mechanism 300 is providing weight resistance to user U, as disclosed in more detail herein.

As can be seen in FIG. 2, which is being used to show the general components and structural layout of the treadmill 10, user U stands on the treadmill 10, specifically belt 20, and grips resistance arm 14 generally by the hand grip portion 216. Resistance arm 14 is operationally connected to moment arm weight resistance mechanism 300 via main cable 302, pulley system comprising pulleys 304, 306, 308, and cam cable 326. Generally, main cable 302 is attached at one end to resistance arm 14, preferably centrally along hand grip portion 216 if a single main cable 302 is used, and is attached at another end to anchor 310. Anchor 310 is secured to one of the uprights 210, and preferably to an interior wall of one of the uprights 210. In between resistance arm 14 and anchor 310, main cable travels through tri-pulleys 304, console pulleys 306, and lifting pulley 308. Cam cable 326 operatively connects lifting pulley 308 with cam 312, and therefore with moment arm weight resistance mechanism 300, and is attached at one end to lifting pulley frame 308A and is attached at another end to cam 312.

Tri-pulleys 304 and console pulleys 306 can be and preferably are fixed class 1 pulleys that are mounted on or within console 212 to direct and redirect the force of main cable 302 and do not move, except to rotate as main cable 302 moves over them. Lifting pulley 308 can be and preferably is a movable class 2 pulley to transform the force of main cable 302 to cam cable 326. Although all pulleys 304, 306, 308 can be fixed pulleys or movable pulleys, or a combination of fixed and movable pulleys, depending on the relative force needed to operate the moment arm weight resistance mechanism 300, this combination of fixed and movable pulleys provides a suitable transformation of the user's U energy to the actuation of the moment arm weight resistance mechanism 300.

A first embodiment of moment arm weight resistance mechanism 300 as illustratively shown in FIG. 2 comprises cam 312, moment arm 314, weight 316, weight adjusting drive 318, weight adjusting mechanism support 320, pivot point 322 (corresponding to the end of the moment arm pivot rod 252), and weight adjusting motor 324. Moment arm 314 is secured to moment arm pivot rod 252 and extends generally normal to the axis of moment arm pivot rod 252. Thus, moment arm 314 acts as a cantilever extending from moment arm pivot rod 252, and the combination of moment arm 314 and moment arm pivot rod 252 can rotate about the axis of moment arm pivot rod 252. In this embodiment, moment arm 314 is a generally flat runway on which weight 316 can roll, can be termed an open arm, and is disclosed in more detail below.

FIG. 3 is a side view of the invention very similar to FIG. 2 but showing user U operating the treadmill 10 in an inclined dragging or pulling simulation with a full resistance arm 14 extension. In this position, user U is simulating an inclined uphill dragging or pulling motion and is walking or running backwards and uphill and pulling on resistance arm 14, and thus pulling against moment arm weight resistance mechanism 300 and moving uphill. FIG. 3 shows a second embodiment of the moment arm weight resistance mechanism 300 and a five-section resistance arm 14 in which the hand grip portion 216 is separate from the two upper resistance arms 14A. Again, the multi-part structure of resistance arm 14 allows the appropriate motion of resistance arm 14 and hand controller 16 relative to user U for self-alignment of the resistance arm 14 and for proper and comfortable operation of treadmill 10. As can be seen, in the inclined position for pulling or dragging, the rear of the treadmill 10 is elevated relative to the front (console end) of the treadmill 10, to allow the simulation of pulling or dragging a load uphill.

A second embodiment of moment arm weight resistance mechanism 300 as illustratively shown in FIG. 3 comprises cam 312, moment arm 314, weight 316, weight adjusting drive 318, pivot point 322 (corresponding to the end of the moment arm pivot rod 252), and weight adjusting motor 324. Moment arm 314 can be secured to moment arm pivot rod 252 via weldments 344, and extends generally normal to the axis of moment arm pivot rod 252. Thus, moment arm 314 acts as a cantilever extending from moment arm pivot rod 252, and the combination of moment arm 314 and moment arm pivot rod 252 can rotate about the axis of moment arm pivot rod 252. In this embodiment, moment arm 314 is a generally box-like structure in which weight 316 can roll, can be termed a closed arm, and is disclosed in more detail below in connection with FIGS. 10 and 11.

FIG. 4 is a side view of the invention very similar to FIG. 2 but in an inclined forward walking mode with no resistance arm 14 extension. In this position, a user is simulating an inclined uphill walking motion and is walking or running forwards uphill. As can be seen, in the inclined position for forward walking or running, the front (console end) of the treadmill 10 is elevated relative to the rear of the treadmill 10, to allow the simulation of walking or running forward uphill. In this mode, the resistance arm 14 rests on or is removably secured to dock 360 such that resistance arm 14 acts as a conventional hand grip bar found on conventional walking treadmills. Dock 360 secures resistance arm 14 so as to minimize or stop all forward, backward, and side to side movement of the resistance arm 14. Moment arm weight resistance mechanism 300 is not necessary or used in the forward walking or running mode.

FIG. 5 is a side view of the invention focusing in on the operative relationship between the resistance arm 14 and the moment arm 314 in what is termed the resting mode. In this mode, the resistance arm 14 is docked in dock 360 and moment arm 314 is in an angled down position, preferably resting on a support or being supported such that no or a minimal amount of weight or force is being transferred to cam cable 326, main cable 302 or resistance arm 14. This view also illustrates the relationship of cam cable 326 to cam 312. More specifically, cam cable 326 is attached at one end to lifting pulley frame 308A and is attached at another end to cam 312 typically at some point along attachment side 312A. In between, cam cable 326 is located along attachment side 312A and then curves along curved side 312B before losing touch with cam 312 and traveling to lifting pulley frame 308A.

FIG. 6 is a side view of the invention focusing in on the operative relationship between the resistance arm 14 and the moment arm 314 in what is termed the operating mode. In this mode, the resistance arm 14 is being pulled by a user, thus pulling on the main cable 302. Main cable is pulled through tri-pulleys 304 (see FIG. 12 for more detail) and console pulleys 306 (see FIG. 1 for more detail) so as to direct or redirect main cable from resistance arm 14 ultimately to anchor 310. In one illustrative embodiment, main cable 302 travels through (and within the interior of) console 212 and upright 210 for aesthetics and safety purposes. As main cable 302 is pulled, lifting pulley 308 is raised, thus pulling on cam cable 326, which operates to rotate cam 312. Cam 312 also is secured to moment arm pivot rod 252, and the rotation of cam 312 caused by the pulling of cam cable 326 causes moment arm pivot rod 252 to rotate. As moment arm 314 also is secured to moment arm pivot rod 252, the rotation of moment arm pivot rod 252 by the rotation of cam 312 causes moment arm 314 to rotate upwards into the operating position. Release of the resistance arm 14, that is moving the resistance arm 14 towards the console 212 and/or docking the resistance arm onto the dock 360, has the opposite rotational effect.

A comparison of FIGS. 2 and 3 illustrates that the use of one or more pivot points such as hinges 28, 28A allows the various sections of resistance arm 14 to pivot relative to each other, to user U, and to the console support 210, resulting in a self-aligning feature. For example, as user U grasps resistance arm 14, user U can move resistance arm 14 upwards and downwards, and towards or away from user U, so as to place hand controller 16 and hand grip portion 216 in a position most comfortable to user U. Further, as the pivot points are freely pivotable, hand grip portion 216 in effect self-aligns to an appropriate position relative to user U simply upon being grasped by user U. The addition of additional pivot points, such as by making resistance arm 14 multi-sectional, can enhance this self-aligning feature. Thus, as can be seen in the comparison between FIGS. 2 and 3, the hand grip portion 216 can remain at a constant height relative to user U no matter what the extension of the resistance arm 14 (partial extension in FIG. 2 and full extension in FIG. 3). More specifically, FIG. 2 illustrates a three-part resistance arm 14 in which hand grip portion 216 is not pivotable relative to, and is a part of, upper resistance arm 14A, and therefore maintains a more limited position, while FIG. 3 illustrates a five-part resistance arm 14 in which hand grip portion 216 is pivotable relative to, and is not a part of, upper resistance arms 14A via hinge 28A, and therefore can be moved to more positions, such as the forward tilting position shown. Further, as the user U exercises, the user U may pull, raise or lower the resistance arm 14, which can freely move to the comfort of the user U.

Although moment arm 314 is shown on the side of treadmill 10 and extending from front to back in the illustrative examples shown in FIGS. 1 through 6, the moment arm weight resistance mechanism 300 and thus moment arm 314 can be located between uprights 210, therefore extending from side to side. The location of moment arm weight resistance mechanism 300 can be changed depending on the desired aesthetics of the treadmill 10 with relocation of the various operating components, such as the cables 302, 326 and pulleys 302, 306, 308.

As can be seen in FIGS. 2 and 3, base 12 can comprise a separate motor housing 32 and belt platform 34. Motor housing 32 contains the various conventional motors and associated components for moving belt 20 and for raising and lowering base 12 and belt platform 34 for inclined exercising. Alternatively, each of the above disclosed elements can be located as desired in either motor housing 32 or belt platform 34 by the person of ordinary skill in the art. In such a configuration, the inclination of belt 20 is accomplished by an incline motor raising the front end of base 12 relative to the rear end of base 12, in a manner well known in the art. For example, as shown in a comparison of FIGS. 2 and 3, an illustrative inclination mechanism is provided to permit inclination of belt platform 34 and belt 20. Illustrative lift mechanisms include a leg lift, comprising an incline motor and front legs. Such lift mechanisms are known in the treadmill art.

FIGS. 2 and 4 through 6, and with particular reference to FIG. 6, also illustrate an embodiment of the moment arm weight resistance mechanism 300. In this open arm embodiment, moment arm weight resistance mechanism 300 illustratively comprises cam 312, moment arm 314, weight 316, weight adjusting drive 318, weight adjusting mechanism support 320, pivot point 322 (corresponding to the end of the moment arm pivot rod 252), and weight adjusting motor 324. In this embodiment, moment arm 314 can be a rod, hollow or solid, having a rectangular cross-section, or at least a flat upper surface 328. Alternatively, moment arm 314 can have an I-beam structure, be a flat planar structure, or any equivalent structure that can support weight 316, allow the operative attachment of weight adjusting drive 318 to weight 316, and provide for attachment to moment arm pivot rod 252.

In the open arm embodiment, weight adjusting drive 318 is operatively connected to weight adjusting motor 324 and to weight 316 and can be used to transfer the motion generated by weight adjusting motor 324 to weight 316 and move weight along moment arm 314. In the illustrative example shown, weight adjusting drive 318 is a linear screw attached at one end to weight adjusting motor 324 and attached at another end to weight adjusting drive support 320. Specifically, weight adjusting drive support 320 is journaled into weight adjusting drive support 320 via a bearing, a low friction device, or the equivalent. Weight adjusting motor 324, in this example, turns weight adjusting device 318, which in turn cooperates with a complimentary internal threaded passage on weight 316 or, as disclosed in connection with FIG. 11, a combination of an internal passage 352 and threaded nut 350, so as to move weight 316 back and forth along moment arm 314. Weight adjusting drive 318 is located generally parallel with and slightly offset from moment arm 314.

FIGS. 3 and 10 also illustrate another embodiment of the moment arm weight resistance mechanism 300. In this closed arm embodiment, moment arm weight resistance mechanism 300 illustratively comprises cam 312, moment arm 314, weight 316, weight adjusting drive 318, pivot point 322 (corresponding to the end of the moment arm pivot rod 252), and weight adjusting motor 324. In this embodiment, moment arm 314 can be an elongated hollow box-like structure containing weight 316, weight adjusting drive 318, and weight adjusting motor 324. This embodiment is more self-contained that the open arm embodiment and can help prevent outside interference with the movement of weight 316 and the operation of weight adjusting drive 318 and weight adjusting motor 324.

In the closed arm embodiment, weight adjusting drive 318 is operatively connected to weight adjusting motor 324 and to weight 316 and can be used to transfer the motion generated by weight adjusting motor 324 to weight 316 and move weight along moment arm 314. In the illustrative example shown, weight adjusting drive 318 is a linear screw attached at one end to weight adjusting motor 324 and is free-floating at another end. Weight adjusting motor 324, in this example, turns weight adjusting device 318, which in turn cooperates with a complimentary internal threaded passage or, as disclosed in connection with FIG. 11, a combination of an internal passage 352 and threaded nut 350, on weight 316 so as to move weight 316 back and forth along moment arm 314. Weight adjusting drive 318 is located generally parallel with and slightly offset from moment arm 314.

Weight adjusting motor 324 can be a bidirectional electric motor secured on the upper surface of moment arm. Preferably, weight adjusting motor 324 is located proximal to the pivot point 322 as weight adjusting motor 324 does have some weight and, if located on the free end 330 of moment arm 314, would impart a certain amount of weight to moment arm 314 creating an increased base moment about pivot point 322. Weight adjusting motor 324 can be selected to move weight 316 relative to or along moment arm 314 away from or towards pivot point 322, and therefore must be of sufficient power to accomplish this task. Alternatively, weight adjusting motor 324 can be mounted outside of moment arm 314 and a hole can be located on the end of moment arm 314 to allow weight adjusting drive to extend therethrough and into the interior of moment arm 314 to cooperate with weight 316.

Weight 316 can be any structure having mass. In the illustrative example shown, weight 316 is a solid mass having an internal threaded passage extending from a first side to an opposite second side or, as disclosed in connection with FIG. 11, a combination of an internal passage 352 and threaded nut 350. Internal threaded passage or nut 350 cooperates with the screw thread on weight adjusting drive such that when weight adjusting drive is turned or rotated by weight adjusting motor 324, weight 316 is forced to move linearly. Weight 316 can comprise optional wheels 332 on the bottom and optionally on the top that cooperate with moment arm 314 to allow the easier movement of weight 316 along moment arm 314. Thus, as weight adjusting motor 324 turns weight adjusting drive 318, the complimentary screw threads cooperate and force weight 316 to move linearly along or relative to moment arm 314.

Weight 316 causes a moment about pivot point 322, thus urging a rotation of moment arm pivot rod 252 about its axis. As moment arm pivot rod 252 is rotationally urged, cam 312 also is rotationally urged in the same direction, thus acting on cam cable 326 by pulling cam cable 326 downward or at least imparting a downward tensional force on cam cable 326. The downward force on cam cable 326 is imparted to lifting pulley 308, which imparts a tensional force on main cable 302. The tensional force on main cable 302 is imparted to resistance arm 14, which imparts a pulling force on the user U grasping the resistance arm 14. This creates the pulling or dragging sensation and weight resistance of the invention.

As long as a moment is created about pivot point and the weight 316 remains at the same position along the moment arm 314, simple physics dictates that the magnitude of the moment will remain approximately constant throughout the rotational arc provided for in this invention, thus imparting an approximately constant force on the cable 326 and resistance arm 14 system. Thus, user U will be presented with an approximately constant force simulating the dragging or pulling action (the force pulls back on resistance arm 14 opposite to the direction user U is pulling). This force also is static in that the force applied by moment arm 314 and weight 316 in one direction is balanced by the force applied by user U in the opposite direction, for a net force of zero. Thus, the invention provides an approximately constant static force for the user U. By moving weight 316 along moment arm 314, the magnitude of the moment, and therefore the magnitude of the force applied to resistance arm 14, can be adjusted and changed so as to provide different magnitudes of force to user U and different amounts of exertion during the exercise regimens.

The amount or level of pulling force imparted to the user can be adjusted by moving the weight 316 along the moment arm 314. By pulling force it is meant the counterforce created by the weight resistance mechanism in response to the user pulling on the resistance arm 14 or hand grip controller 216A shown in FIGS. 15 and 16. The pulling force is equal to and opposite the force created by the user pulling on the resistance arm 14 or hand grip controller 216A shown in FIGS. 15 and 16. If the weight 316 is proximal to the pivot point 322, then the moment created by the weight 316 is minimal and therefore the amount or level of pulling force imparted to the user U is minimized. If the weight 316 is distal to the pivot point, then the moment created by the weight 316 is maximized and therefore the amount or level of pulling force imparted to the user U is maximized. Conventional controls on the movable hand controller 16 or the fixed console 212 operate the weight adjusting motor 324 so as to move the weight 316 to the desired position along the moment arm 314 for imparting the desired amount or level of pulling force to the user U as the user U pulls on the resistance arm 14.

Main cable 302 and cam cable 326 can be of any flexible structure, such as a rope, a chain, a belt, monofilaments, braided wires, flexible materials, and other suitable equivalents, that allow a transfer of force between resistance arm 14 and moment arm weight resistance mechanism 300, and is not limited to a standard cable. As disclosed herein, main cable 302 can be directed around one or more pulleys 304, 306, 308 to direct or redirect main cable 302 between the resistance arm 14 and the moment arm weight resistance mechanism 300, and to prevent main cable 302 from becoming entangled in the internal mechanical components of treadmill 10. Thus, in operation, when user U grips resistance arm 14 and starts belt 20 moving, user U begins to walk or run in a simulated backwards direction relative to console 212, causing user U to pull on resistance arm 14. This force transfers to main cable 302, which in turn acts on moment arm weight resistance mechanism 300 by lifting moment arm 314, thus creating the moment due to the weight of the weight 316 (and the moment arm itself, as well as any components on or attached to the moment arm 314), resulting in the pulling force, which in this respect also can be termed a counterforce to the force created by the user U pulling on the resistance arm or the hand grip controller 216A shown in FIGS. 15 and 16.

The degree of weight resistance can be controlled by user U. At settings in which the resistance arm 14 is not docked and weight 316 is creating a moment on moment arm 314 about pivot point 322, user U would be simulating dragging or pulling a weight (the force created by moment arm 314 as transferred to user U) and the exercise regimen would be similar to walking or running backwards while dragging or pulling an object of a weight comparable to the setting of the moment arm weight resistance mechanism 300. The higher the setting of the moment arm weight resistance mechanism 300 (that is, with weight 316 further from pivot point 322), the heavier the simulated object being pulled. With this arrangement, it is therefore possible to vary the weight resistance being dragged or pulled during the exercise regimen. However, once the desired weight resistance is set, the weight resistance is constant and static as transferred to the resistance arm 14 or hand grip controller 216A (see FIG. 15 and the disclosure associated therewith), thus imparting a constant and static weight resistance to the user U.

A comparison of the position of resistance arm 14 in FIG. 5 versus FIG. 6 shows how resistance arm 14 can move. Resistance arm 14 is shown in the at rest position in FIG. 4, and in the operational position (partially extended) in FIG. 6. Resistance arm 14 can pivot between the at rest position and a fully extended position, and the position of resistance arm 14 during operation is dependent on user U. Stops (not shown) prevent resistance arm 14 from moving past the at rest position in one direction of motion and the fully extended position in the opposite direction of motion.

FIG. 7 is a top view of an alternative embodiment of the moment arm weight resistance mechanism 300 of the invention. This embodiment has the weight adjusting motor 324 mounted to the side of the moment arm 314, such as on the moment arm pivot rod 252. Weight adjusting drive 318 is a cable, wire, chain, belt, or other flexible material extending around pulleys 320A, which act as the de facto weight adjusting drive supports. Weight 316 is attached to the wire of weight adjusting drive 318. Weight adjusting motor 324 turns one of the pulleys 320A, which causes the movement of the weight adjusting drive 318 about the pulleys 320A, thus moving the weight 316 along or relative to the moment arm 314 in either direction. FIG. 8 is a side view of the alternate embodiment of the moment arm weight resistance mechanism 300 shown in FIG. 7.

FIG. 9 is a side view of another alternate embodiment of the moment arm mechanism 300 of the invention. This embodiment has the weight adjusting motor 324 located within a car 334, and with weight 316 attached to the car 334. Weight adjusting drive 318 again is a screw, but this time journaled between two weight adjusting drive supports 320 located on opposite ends of the moment arm 314. Weight adjusting motor 324 cooperates directly with weigh adjusting drive, such that when weight adjusting motor 324 is actuated, a threaded passage within weight adjusting motor 324 cooperate with the external screw thread of weight adjusting drive 318, and weight adjusting motor 324 moves along weight adjusting drive 318. Being in a cart 334 with wheels 332 allows weight adjusting motor 324 and attached weight 316 to move along or relative to moment arm 314.

FIG. 10 is a sectional perspective view of the second embodiment of the moment arm weight resistance mechanism 300 shown in FIG. 3 in larger detail. As can be seen, moment arm 314 is a generally hollow, elongated, box-like structure containing weight 316, weight adjusting drive 318 and weight adjusting motor 324. Moment arm 314 is illustratively shown as being welded onto moment arm pivot rod 252 by weldments 344, but moment arm 314 can be secured to moment arm pivot rod 252 by any known or suitable means. Weight 316 in this example comprises wheels 332 on both its top and bottom surfaces, which can provide for smoother and quieter rolling and less friction between weight 316 and the interior surfaces of moment arm 314.

FIG. 10 also shows an embodiment of cam 312 in more detail. Specifically, the side of cam 312 that cooperates with cam cable 326 can have a groove 362 into which cam cable 326 can lie. Such a groove 362 can help direct and secure cam cable 326 during operation and can help prevent cam cable 326 from slipping off of cam 312.

FIG. 11 is a sectional side view of a weight 316 and weight adjusting drive 318 that can be used with the present invention. Weight 316 comprises internal passage 352 extending therethrough from one side to an opposite side. In this embodiment, internal passage 352 is a smooth bore with no screw thread. The diameter of internal passage 352 is greater than the outer diameter of the screw thread 354 of weight adjusting drive 318 such that weight adjusting drive 318 can slide into and through internal passage 352. One or more threaded nuts 350 are inserted into internal passage 352 and secured by known means, such as, but not limited to, friction, adhesives, welding, soldering, clips, a flange that is part of the nut 350 itself and screwed into the weight 316, and the like. Weight adjusting drive 318, and particularly screw thread 354 of weight adjusting drive 318 cooperates with screw thread 356 of nut 305 such that when weight adjusting drive 318 is rotated, as disclosed herein, weight 316 will move relatively along weight adjusting drive 318.

FIG. 12 is a side view of one illustrative embodiment of tri-pulleys 304 and the main cable 302 configuration traveling through tri-pulleys 304. Generally, main cable 302 is attached to resistance arm 14, loops under first tri-pulley 304A, over second tri-pulley 304B, and under third tri-pulley 304C before being redirected to console pulley 306. The use of tri-pulleys 304 helps maintain tension within the main cable 302 and helps reduce the possibility that main cable 302 will fall off of pulleys 304. For example, if resistance arm 14 is moved away from and below first tri-pulley 304A, then main cable 302 can lose contact with first tri-pulley 304A. If first tri-pulley 304A was the only pulley 304, then main cable 302 could get tangled or lose contact with console pulley 306. However, the presence of second tri-pulley 304B maintains main cable 302 in a proper position. Third tri-pulley 304C is used to redirect main cable 302 to a position directly below console pulley 306 such that main cable 302 enters console pulley 306 at a proper angle. Other configurations of pulley 304 and pulley 306 are contemplated, and this configuration is only for illustrative purposes.

FIG. 13 shows an illustrative movable hand controller 16 and mounted console display 218, either or both of which can include electronic controls and information displays that typically are provided on exercise treadmills for purposes such as adjusting the speed and incline of treadmill 10, the time user U has been operating treadmill 10 and/or the time left in a set exercise regimen, user's U heart rate, the simulated load being dragged or pulled, on and off buttons, and an emergency off button, and other functions. A number of visual displays can be included on hand controller 16 and console display 218 including time display that displays the elapsed time of an exercise regimen or the time remaining in a count down for an exercise regimen, heart rate display that shows the heart rate of user U assuming a heart rate monitor is being used and treadmill 10 include the features of heart rate monitoring, incline display representing the incline of belt 20 in degrees or other units, load display representing the load or weight being dragged or pulled, and speed display representing how fast user is moving. Such displays are known in the treadmill art.

Additional displays can include a mile display to display the simulated distance traveled by user U during the exercise regimen, a calorie display to display the current rate of user U calorie expenditure or the total calories expended by user U during the exercise regimen. Further, hand controller 16 and console display 218 can include an input key pad with which user U can communicate with a microprocessor that operates treadmill 10 so as to operate treadmill 10 as well as set the parameters for exercise regimens. Also included on hand controller 16 or console display 218 is or can be on-off buttons, emergency stop button, increase buttons to increase a parameter, decrease buttons to decrease parameters, and other functional input devices. All of these are known in the treadmill art. Further, hand grips 216 also can comprise input means (not shown) for reading user's U heart rate, as is known in the art.

FIG. 14 is a side view, partly in section, of the invention operating in reverse dragging/pulling mode in an inclined position, showing a hand grip portion 216 detached from the rest of the resistance arm 14 and having a free range of motion. For example, as illustrated using a five-part resistance arm 14, the hand grip portion 216 can be removed from the rest of the resistance arm 14 and used by the user U. As main cable 302 is attached to the hand grip portion 216, this embodiment will still actuate the moment arm weight resistance mechanism 300. In this embodiment, hinge 28A can be a removable hinge comprising, for example, cotter pins or other removable pins.

FIG. 15 is a side view, partly in section, of the invention operating in reverse dragging/pulling mode in an inclined position, showing a first embodiment of the moment arm weight resistance mechanism 300 and a movable hand grip controller 216A operatively connected to the weight resistance mechanism 300 via main cable 302. The embodiment of FIG. 15 is an alternative to the embodiment of FIG. 2 and without a resistance arm 14. In FIG. 15, user U is simulating a inclined surface dragging or pulling motion and is walking or running backwards and pulling on hand grip controller 216A and thus pulling against moment arm weight resistance mechanism 300. As can be seen, the cable connection of hand grip controller 216A provides an unrestricted range of motion relative to user U for the self-alignment of the hand grip controller 216A and for proper and comfortable operation of treadmill 10.

As can be seen in FIG. 15, user U stands on the treadmill 10, specifically belt 20, and grips hand grip controller 216A. Hand grip controller 216A is operationally connected to moment arm weight resistance mechanism 300 via main cable 302, pulley system comprising pulleys 304, 306, 308, and cam cable 326. Generally, main cable 302 is attached at one end to hand grip controller 216A, and is attached at another end to anchor 310. Anchor 310 is secured to one of the uprights 210, and preferably to an interior wall of one of the uprights 210. In between hand grip controller 216A and anchor 310, main cable travels through tri-pulleys 304, console pulleys 306, and lifting pulley 308. At least some of tri-pulleys 304 can be mounted so as to be able to swivel or have a lateral range of motion such that if main cable 302 is pulled off to one side by the user, main cable 302 be more likely to remain within the respective tri-pulley 304. Cam cable 326 operatively connects lifting pulley 308 with cam 312, and therefore with moment arm weight resistance mechanism 300, and is attached at one end to lifting pulley frame 308A and is attached at another end to cam 312. In most other respects, the operation of the treadmill 10 using the hand grip controller 216A is the same as that described for the resistance arm 14 disclosed in connection with FIGS. 2 through 6.

FIG. 16 is a top view of an embodiment of the hand grip controller 216A shown in use in FIG. 15 and operatively connected to the weight resistance mechanism 300. Hand grip controller 216A can comprise various control features, such as incline, weight resistance, and belt speed controls, a stop control and other controls necessary or desirable for the operation of the device. Handles 217 can be ergonomically shaped for the comfort of user U and for proper operation of the device. FIG. 16 also illustrates a fixed control console 212 separate and apart from movable hand grip controller 216A.

FIG. 17 is a top view of an embodiment of the invention showing controller features both on movable resistance arm 14 and the fixed console controller 212.

FIG. 18 is a side view, partly in section, of an alternate pneumatic weight resistance mechanism 400 in the resting position. In this embodiment, the weight resistance mechanism 400 is a pneumatic mechanism comprising a pneumatic cylinder 402, an air compressor 404, and various connecting hoses 406. In known pneumatic mechanisms, the resistance of the pneumatic cylinder 402 can be set to certain values corresponding to a known weight resistance by the setting of the compressor 404 (the higher the pressure of the compressed air produced by the compressor 404, the higher the resistance of the pneumatic cylinder 402, and the higher the equivalent weight resistance). Similarly, the weight resistance mechanism can be a hydraulic cylinder and the air a fluid. Pneumatic cylinder 402 is attached to the frame of the device and cylinder rod 408 is attached to rod pulley 410. Pulling on resistance arm 14 or hand grip controller 216A ultimately, via cabling and pulleys as disclosed previously, pushes cylinder rod 408 into pneumatic cylinder 402, with the air within pneumatic cylinder 402 providing resistance. The use of a pneumatic cylinder 402 with known or adjustable resistance is known and can be used to provide a basis for determining the simulated resistance weight being dragged or pulled by user U. FIG. 19 is a side view, partly in section, of the alternate pneumatic weight resistance mechanism 400 in a resistance position.

FIG. 20 is a front view, partly in section, of an alternate electric motor clutch brake weight resistance mechanism 500. In this embodiment, the weight resistance mechanism 500 is an electric motor and clutch braking system comprising an electric motor 502 and a clutch brake assembly 504. In known systems of this type, the electric motor 502 imparts a force through the clutch brake assembly 504 to the movable resistance arm 14 or hand grip controller 216A, which can correspond to a known weight resistance by the power supplied to the motor 502 or to the clutch brake assembly 504. Motor 502 is attached to the frame of the device and clutch brake assembly 504 is attached to cam 512. When motor 502 is actuated, cam 512 is rotated, thus ultimately, via cabling and pulleys as disclosed previously, pulling on resistance arm 14 or hand grip controller 216A providing resistance to user U holding resistance arm 14 or hand grip controller 216A. The use of a clutch brake assembly 504 with known or adjustable resistance is known and can be used to provide a basis for determining the simulated resistance weight being dragged or pulled by user U.

Treadmill 10 utilizes a known microprocessor (not shown) or other suitable electronic controller to control and operate the various features of the invention. For example, the speed of belt 20, can be controlled by the microprocessor or other suitable electronic controller. The speed is adjustable from controls on hand controller 16, hand grip controller 216A, or console 212 making it possible to vary the speed of belt 20 during the exercise regimen. Further, the inclination of belt 20 also can be controlled by the microprocessor or other suitable electronic controller. For example, the inclination of the base 12, and thus the treadmill 10 can be illustrated by a simple incline mechanism in which a lever leg 302 is rotated by an incline motor to raise and lower base 12. Actuation of incline motor causes the rotation of lever-leg 36 in the desired direction, thus raising or lowering base 21 and belt platform 34, thus causing the decline or incline, respectively, of belt platform 34. The degree of inclination chosen by user U is adjustable from controls on hand controller 16 or console 212 making it possible to vary the inclination of belt 20 during the exercise regimen.

Additionally connected to the microprocessor or other suitable electronic controller are the various display and other elements of the hand controller 16 and the console display 218. For the sake of simplicity, the signals are transmitted to and from the microprocessor or other suitable electronic controller to the hand controller 16, hand grip controller 216A, and console display 218, and are operatively connected to switches, dials, etcetera on the hand controller 16 and console display 218 and the specific elements, such as belt motor, incline motor, and moment arm weight resistance mechanism 300. Again, the use of this type of microprocessor or other suitable electronic controller is well known in the treadmill art.

The invention also can comprise additional optional features. For example, the invention can comprise a safety mechanism to prevent user U from inadvertently speeding up the movement of belt 20, and from speeding up the movement of belt 20 to a speed faster than what is inputted. In other words, treadmill 10 can further comprise a means for preventing belt 20 from running out from under user U should either user U move too fast relative to belt 20 or belt 20 move too fast relative to user U. This also would help prevent the force of user's U foot plant from undesirably increasing the speed of belt 20. Clutches attached to belt 20 can be used, among other known mechanisms. For another example, step offs optionally can be located on the sides and ends of the base 12 and can be a substantial width to allow for a wider platform for user U to step onto or step off of treadmill 10. Side rails and kill switches also can be used. Heart rate monitors can be used, and the microprocessor, or other suitable electronic controllers, can be configured to allow for heart rate monitoring and for the adjustment of belt 20 speed and incline and the level of weight resistance to maintain a desired heart rate.

In stark contrast to known treadmills, the present invention accomplishes a different exercise regimen than an aerobic walking or running workout. Initially, belt 20 can travel in the opposite direction than the belt on known treadmills to provide the basis for the dragging or pulling motion. Further, the use of a moment arm weight resistance mechanism 300 in combination with a walking or running motion in general and a backwards walking or running motion in particular provides a more complex exercise regimen. It has been found that the combination of walking or running backwards in conjunction with the simulation of dragging or pulling a load provides a useful aerobic and/or anaerobic work out and can strengthen various muscles and muscle groups, specifically leg muscles and the gluteus maximus and also possibly arm, chest, shoulder and back muscles.

Other alternatives and embodiments can comprise one or more of the following features. The treadmill drive motor assembly and incline assembly can be positioned at either end, or in the middle, of the base. The belt platform can incline and decline in both directions, providing incline or decline resistance for both conventional treadmill operation and for reverse treadmill operation. Additionally, the invention can have more common features including the ability to incline and decline at various or continuous degree settings and a belt that moves at various or continuous speeds. Further, there can be two or more resistance arms with each resistance arm or the equivalent being a one-, two- or multi-piece structure with the hand console being pivotally or hingedly attached to one or more of the resistance arms or the equivalent. Alternative weight adjusting drives and motors can include electromagnets, mechanical levers, and the like.

Additional alternative include eliminating cam 312 and attaching the cam cable 326 directly to the moment arm 314, or, in the alternative, the cam 312, cam cable 326, pulley 308, and pulley frame 308A can be eliminated and main cable 302 can be attached directly to moment arm 314. Pulley 308, pulley frame 308A, and cam cable 326 can be eliminated and main cable 302 can be attached directly to the moment arm 314. Cam 312 can be eliminated and the cam cable 326 can be attached directly to the end of the moment arm distal from the pivot point 322, or in the alternative, the cam 312, cam cable 326, pulley 308, and pulley frame 308A can be eliminated and main cable 302 can be attached directly to the end of the moment arm distal from the pivot point 322.

In normal operation, user U will step onto belt 20 and grasp resistance arm 14 or hand grip controller 216A, positioning himself or herself generally centrally on belt 20 so as to face the console 212. As belt 20 begins to move, user U will start a rearward walking or running motion towards the rear of treadmill 10, with belt 20 moving accordingly, such that user U will remain generally in the same position centrally on belt 20 as treadmill 10 is operating. Alternatively, treadmill 10 may be set up to begin to move automatically at a speed according to a value entered from hand controller 16, hand grip controller 216A, or console 212. Alternatively, belt 20 can be in a manual mode, moving only when the user U walks. The pace of the walking or running motion may be increased or decreased depending upon the speed of belt 20. The speed of belt 20 can be controlled by the adjustment of the controls on hand controller 16, hand grip controller 216A, or console 212, along with the adjustment of the inclination of treadmill 10 and other functions and features. Belt 20 also can comprise two belts, one for each foot, as an alternative. The user U pulls on resistance arm 14 or hand grip controller 216A, which as previously disclosed actuates moment arm weight resistance mechanism 300. The user U can adjust the amount or level of weight resistance, either prior to stepping on the machine or during the exercise routine itself while the user U is carrying out the pulling or dragging motion, and can proceed to enjoying a pulling or dragging exercise regimen.

The weight resistance mechanism can be set by the user to a specific amount, such as for example 10 kilograms, comparable to known weight resistance mechanism such as weight stacks. Thus, when the user pulls on the movable resistance arm or hand grip, the weight resistance mechanism exerts a counterforce on the user of the set weight, 10 kilograms in this example. The counterforce is static and approximately constant at the set weight throughout the entire range of movement of the movable resistance arm, hand grip or hand grip controller, except in some embodiments at the very start of the range of motion when the weight resistance mechanism is resting on a stop. That is, the weight resistance mechanism exerts a counterforce on the user of the set weight, 10 kilograms in this example, whether the user has pulled the movable resistance arm, hand grip or hand grip controller one centimeter or one meter, and this set weight is static and approximately constant, at 10 kilograms in this example, unless the weight resistance mechanism is reset to a different amount. Thus, the degree of weight resistance of the weight resistance mechanism can be controlled by the user to simulate dragging or pulling a weight such that the exercise regimen is similar to walking or running backwards while dragging or pulling an object of a weight comparable to the setting of the weight resistance mechanism. The higher the setting of the weight resistance mechanism, the greater the force acting on the resistance arm, hand grip or hand grip controller, and the heavier the simulated object being pulled. The degree of weight resistance also is adjustable in that the user can set the specific amount of weight resistance to any amount within the parameters of the weight resistance mechanism structure prior to and during the exercise regimen, depending on the embodiment of the invention.

In preferred embodiments, the weight resistance mechanism is a moment arm mechanism comprising a moment arm, an adjustable weight, and a drive mechanism for moving the adjustable weight relative to or along the moment arm. As the adjustable weight is adjusted along the moment arm relative to a pivot point of the moment arm, the weight resistance of the moment arm is increased or decreased, thus simulating the dragging or pulling of various or varying load weights. The moment arm is operatively connected to the movable resistance arm via the main cable, thus transferring the weight resistance effect to the user. Thus, when the user pulls on the movable resistance arm of hand grip so as to activate the moment arm, the moment arm creates an approximately constant and static counterforce equivalent to the specific weight amount set by the user.

Thus, in a simple form the invention is an exercise machine for simulating a dragging and pulling action comprising an endless movable surface looped around rollers or pulleys to form an upper run and a lower run, the moveable surface being rotated when one of the rollers or pulleys is rotated, thereby creating an exercise surface for walking or running, the improvement comprising (a) a constant, adjustable, one directional resistance means that produces a load or force for simulating a dragging and pulling action and (b) one or more handle(s) that is/are operatively attached to the resistance means that the user can grasp and or pull while walking or running backwards on the treadmill to simulate the dragging or pulling action. The resistance arm or hand grip controller is/are acted upon with a constant adjustable one directional resistance (that is resistance only in the direction pulling the handle(s) away from the user) when being used to simulate a dragging or pulling action.

The endless moveable surface can be operable in both a forward and reverse direction so as to be also usable as a conventional forward walking or running treadmill. The exercise machine also can comprise a grade or elevation adjustment mechanism for adjusting the walking or running surface between various incline, flat and decline positions.

The resistance means can be produced by any of the following means: leverage, moment arm or cantilevered members coupled with one or more solid, semi-solid or liquid filled mass(s); electric motors, electronic or eddie current brakes; one or more metal or other solid mass weights; pneumatics or hydraulics; various types of springs, friction members, flexible rods, tension devices, or the like; and any combination thereof.

The console, hand grip or hand grip controller can comprise controls for manipulating the various functions of the machine by the user such as but not limited to: the direction of travel of the walking/running surface, the speed of the walking/running surface, the grade or elevation of the walking/running surface, the amount of force of the resistance system applied to the resistance arm, hand grip or hand grip controller, informational data useful to the user. The machine function controls and informational data also may be contained on one or more stationary housing(s) on any part of the fixed frame.

The resistance arm or hand grip also can be attached to some portion of the fixed frame of the machine in a pivoting, linear slide or arcing slide fashion, or attached only to the operative connective means that is attached to the resistance means. Such operative connecting means include belts, ropes, cables, chains or other suitable flexible materials as well as rigid levers, arms, linkages and the like or any combination thereof.

The exercise machine of the present invention can simulate a dragging and pulling action by the following illustrative method:

a) A user steps onto a moveable endless surface looped around rollers on either end as with known treadmills and grasp moveable pulling handle(s) that is/are operatively connected to a resistance means that produces a constant, adjustable, one directional resistance against the pulling handle(s).

b) The user manipulates the controls of the machine such that the endless moveable surface moves in the direction that the user is facing causing the user to walk or run in a backwards direction.

c) While walking or running backwards, the user pulls on the handle(s), which in turn actuates the resistance means, which imparts a constant, adjustable one directional resistance on the pulling handle(s) in a direction away from the user, that is, in a direction opposite the force of the resistance on the pulling handle(s).

d) While continuing to walk or run backwards, the user then either can hold the handle(s) in a fixed position anywhere in the moveable range of motion of the handle(s) to simulate a dragging action or can pull on and release the force against the handles to produce a pulling and dragging action or any combination thereof for the duration of the exercise period.

e) Throughout the duration of the exercise period, the user can manipulate all functions and informational data of the machine via controls contained on the movable handle(s) and or mounted on a stationary portion of the frame of the machine.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

What is claimed is:

1. An exercise treadmill of the type having an endless moveable surface looped around rollers or pulleys to form an upper run and a lower run, the movable surface being rotated when one of the rollers or pulleys is rotated, and an exercise surface for walking or running while exercising, comprising:

a) a weight resistance mechanism for providing a weight resistance for simulating the dragging or pulling of a load, wherein the weight resistance can be adjusted and set to a specific weight resistance setting;

b) a movable hand controller operatively attached to the weight resistance mechanism for operating and controlling the exercise treadmill and the weight resistance mechanism, wherein the endless movable surface moves in a direction simulating walking or running backwards, wherein the weight resistance mechanism is selected from the group consisting of moment arm weight resistance mechanisms, pneumatic weight resistance mechanisms, hydraulic weight resistance mechanisms, and electric motor clutch brake weight resistance mechanisms, and wherein the weight resistance mechanism exerts an approximately constant and static counterforce to the hand controller generally only in the same direction as the endless movable surface moves and opposite a pulling direction, whereby operation of the treadmill simulates the dragging or pulling of a load by a combination of the actuation of the weight resistance mechanism to simulate the load and the walking or running backwards to provide the dragging or pulling action.

2. The exercise treadmill as claimed in claim 1, wherein the counterforce is static and constant at the set weight throughout an entire range of movement of the movable hand controller.

3. The exercise treadmill as claimed in claim 1, wherein the weight resistance mechanism can be set to a chosen weight resistance level that is adjustable for providing weight resistance only against the pulling direction.

4. The exercise treadmill as claimed in claim 1, further comprising an inclination mechanism to permit inclination of the exercise surface to simulate an incline or decline.

5. An exercise treadmill comprising:

a) an endless moveable surface for walking or running, wherein the endless movable surface is movable in a direction simulating walking or running backwards;

b) a weight resistance mechanism for simulating the dragging or pulling of a load, wherein the weight resistance mechanism provides weight resistance only generally opposite a pulling direction; and c) a movable hand controller operatively attached to the weight resistance mechanism for operating and controlling the exercise treadmill and the weight resistance mechanism, wherein the endless movable surface moves in a direction simulating walking or running backwards, wherein the weight resistance mechanism is selected from the group consisting of moment arm weight resistance mechanisms, pneumatic weight resistance mechanisms, hydraulic weight resistance mechanisms, and electric motor clutch brake weight resistance mechanisms, and wherein the weight resistance mechanism applies an approximately constant and static counterforce to the hand controller generally only in the same direction as the endless movable surface moves and opposite the pulling direction and approximately at the set weight throughout an entire range of movement of the movable hand controller, whereby operation of the treadmill simulates the dragging or pulling of a load by a combination of the actuation of the weight resistance mechanism to simulate the load and the walking or running backwards to provide the dragging or pulling action.

6. The exercise treadmill as claimed in claim 5, wherein the weight resistance mechanism can be set to a chosen weight resistance level that is adjustable for providing weight resistance.

7. The exercise treadmill as claimed in claim 6, further comprising an inclination mechanism to permit inclination of the exercise surface to simulate an incline or decline.

* * * * *